US012692711B2

(12) United States Patent
Hardman

(10) Patent No.: US 12,692,711 B2
(45) Date of Patent: Jul. 28, 2026

(54) AUTOMATIC DRYWALL COMPOUND AND DRYWALL TAPE APPLICATOR

(71) Applicant: Richard Hardman, Bayfield, CO (US)

(72) Inventor: Richard Hardman, Bayfield, CO (US)

( * ) Notice: Subject to any disclaimer, the term of this patent is extended or adjusted under 35 U.S.C. 154(b) by 323 days.

(21) Appl. No.: 18/193,101

(22) Filed: Mar. 30, 2023

(65) Prior Publication Data

US 2024/0328174 A1 Oct. 3, 2024

(51) Int. Cl.
*E04F 21/165* (2006.01)
*E04F 21/02* (2006.01)

(52) U.S. Cl.
CPC ..... *E04F 21/1657* (2013.01); *E04F 21/026* (2013.01)

(58) Field of Classification Search
CPC .... E04F 21/1657; E04F 21/026; E04F 21/165
See application file for complete search history.

(56) References Cited

U.S. PATENT DOCUMENTS

2015/0367377 A1* 12/2015 Negri ..... B05D 1/40
118/325

* cited by examiner

*Primary Examiner* — Michael A Tolin
*Assistant Examiner* — Christopher C Caillouet
(74) *Attorney, Agent, or Firm* — Michael L. Greenberg, Esq.; Greenberg & Lieberman, LLC

(57) ABSTRACT

A supplementary device for enhancing the operability of an automatic drywall tape applicator including a supply tube capable of being enclosed within a material reservoir sleeve utilizing a plurality of actuators being positioned in a perpendicular relationship to the longitudinal axis of said automatic drywall tape applicator for supplying a continuous flow of drywall compound.

4 Claims, 17 Drawing Sheets

AUTOMATIC DRYWALL COMPOUND AND DRYWALL TAPE APPLICATOR

FIELD OF THE PRESENT INVENTION

The present invention relates generally to an apparatus for receiving drywall compound from a remote location to be used in the process of applying drywall compound and tape to drywall panel joints. More particularly, the present invention pertains to a supplementary device that provides a flow of drywall compound in conjunction with an ergonomic control system to assist in manipulating various functions of an automatic drywall tape applicator commonly used in the drywall industry.

BACKGROUND OF THE PRESENT INVENTION

Drywall installation can be provided in a variety of methods depending upon whether the project is new construction, a repair, a remodel, or a commercial building project. Most commonly drywall panels are affixed to the interior stud surfaces of wall and ceiling framing within a building structure. The adjoining panels result in joints located between the various pieces of drywall. These joints are covered with a non adhesive backed paper tape. The paper tape is adhered to the drywall surface with a thin layer of drywall compound that is applied wet between the paper tape and the drywall panel surface. The tape adheres to the drywall panel surface during the drying process. After the tape application dries, one or more smoothing coats of additional drywall compound are applied in a manner to smooth a thin layer of drywall compound over the tape so as to blend the surface of the newly applied compound onto the surrounding drywall panel surface. After smoothed, the drywall surface can be textured with an independent texturing machine or painted. When reduced production time is of importance to the construction schedule a technician most often uses automatic taping tools such as the Ames Taping Tools system, or the Drywall Master Tool system to apply the first taping step in the covering process. Automatic tool systems typically consist of a set of applicators that include a manually refillable taper machine known as an automatic drywall tape applicator, refillable box spreader devices that come in different widths, a corner roller tool that is used to embed the compound backed paper tape into a corner joint, a mastic pump, a corner smoothing tool and various handles that the technician uses to apply pressure between the automatic tools and the drywall panel surface. Each applicator is filled with drywall compound using a manual hand pump from a bucket after which the material is manually pressure forced out of the applicator onto the panel surface until it becomes empty and must be refilled again.

The automatic drywall tape applicator used with the manual refilling process is best defined as an apparatus for applying drywall compound and tape to a drywall panel joint and having an applicator head mounted on one end of a drywall compound storage device, there being a drywall compound flow path extending from an opposite end of the storage device to an outlet on the applicator head, an arrangement for delivering drywall compound through the drywall compound flow path, a roller rotatably mounted on the applicator head for contacting a drywall panel, a tape advancing mechanism secured on the applicator head for advancing a supply of tape to the outlet and to the roller, a tape severing device connected to the applicator head for cutting the tape, and a corner wheel assembly moveably mounted to the applicator head. This automatic drywall tape applicator is capable of applying a limited length of paper tape to the joints between the drywall panels before it needs to be refilled. During the taping process one hand of the technician supports the rearward end of the automatic drywall tape applicator apparatus and manually operates a corner wheel trigger that extends a corner wheel located at the opposite forward most end of the device. The corner wheel presses the paper tape into a corner as it is being rolled along an angled drywall panel joint.

The technicians second hand supports an advance and cutting control handle sleeve located circumferentially on the forward section of the apparatus. To advance a new piece of tape required to start another application of tape to the drywall panel the technician moves the sliding sleeve forward toward the front end of the automatic tape applicator. The technician pulls the sliding sleeve back in the direction of the corner wheel trigger to cut the tape.

During the application of paper tape with an automatic drywall tape applicator dual roller wheels located at the forward end of the device are pressured onto the tape and drywall panel surface that pulls the tape from a centrally mounted tape roll and onto the drywall panel surface while drywall compound is simultaneously applied between the tape and the drywall panel surface.

Within the taping head structure of the automatic drywall tape applicator the dual roller wheels are mounted on opposite ends of a rotating axle support that acts as a winding means by which a cable is drawn onto the midsection of the axle as the dual roller wheels rotate along the application surface. At the opposite end of this cable a plunger unit is mounted that slides up the material reservoir sleeve of the automatic taper forcing drywall compound toward the forward end of the automatic drywall tape applicator after which the drywall compound is dispensed on to the paper tape.

With the disadvantage of having to refill the automatic taper each time the applicator empties of drywall compound the technician is unable to provide an efficient manner of application as the technician must stop the application of tape, walk back to the material reservoir and manually pump the compound into the taper once again. The technician commonly travels from the point of application back to the hand pump more than 100 times in an 8 hour work day.

Many attempts to remedy this refilling process have been pursued by inventors that have attached remote pumps to tape application tools by way of a hose that provides a continuous flow of drywall compound from a material reservoir to the point of application. This process is known in the field as a Continuous Flow System.

A Continuous Flow System is abbreviated in the drywall trade as a CFS and has a wide variety of disadvantages to the drywall technician. One major disadvantage with all CFS systems is that they require the technician to discard the automatic drywall tape applicator and other refillable tools the technician has been using as they have no functional compatibility with any CFS system known in the art.

Different CFS systems offer a variety of ways to accomplish the taping, smoothing and texturing process to drywall panel joints. Depending on the tools that are supplied by the manufacturer, one CFS system known as the Ames CFS System includes manually operated taping and smoothing tools that attach to the end of the compound supply hose. Apla Tech has patented a refillable type of tape applicator that is filled with drywall compound from a remote pumping station and utilizes a tethered air source to compress air within its taper structure behind a plunger that pushes against the contained drywall compound and onto the paper tape to be applied to the drywall panel surface. More detailed information on the Ames and Apla Tech Systems is provided in the following section.

Below, several groups of patented drywall tools are specified that have particular relevance to the benefits the present invention offers to the drywall industry. The following list of patents are referenced in groups for easier clarification to those reviewing this application. These groups of patents include Automatic Taping Tools, Continuous Flow System (CFS) Tools and Other.

Automatic Taping Tools

U.S. Pat. No. 2,815,142 patented by R. G. Ames on Dec. 3, 1957 is the original automatic taper that is used in the drywall industry today. Though some minor changes have occurred in later versions, this patented design provides virtually all of the functional concepts used in all modern automatic tapers regardless of the manufacturer.

U.S. Pat. No. 4,090,914 is offered as an automatic tape applicator as is typical in the industry. Though this patent offers minor improvement within the parameters of a typical automatic taper design, the following items relate generally to an automatic taper as are relevant to the present invention. In U.S. Pat. No. 2,815,142 FIG. 1 item 12 is identified as the head of the apparatus. FIG. 1 item 10 (U.S. Pat. No. 2,815,142) designates the material reservoir sleeve. FIG. 8 items 29 (U.S. Pat. No. 2,815,142) specifies opposing roller wheels used to embed the tape and mastic on to the panel surface as were previously described. FIG. 9 in U.S. Pat. No. 2,815,142 provides illustrations of the following relevant components of the standard automatic taper. Also in U.S. Pat. No. 2,815,142 item 77 a creasing roller, Item 38 a shaft, Item 37 a cable, and item 13 denotes a piston. Item 36 illustrates a cable drum by that the cable 37 is wound. As cable drum 36 rotates it pulls the piston 13 up a long hollow barrel 10 shown in U.S. Pat. No. 2,815,142 FIG. 1 Item 37, the plunger cable will break after prolonged use causing the technician to stop production whereby he removes a stop ring 14 (FIG. 1 of U.S. Pat. No. 2,815,142) the piston 13 and the plunger cable 37 from the roller drum 36. He then replaces the broken cable 37 with a new cable, reinstalling one end of the cable 37 to the cable drum 36 and the other end of the cable 37 to the piston 13. Additional repairs are often needed involving a second cable 82 that is described as a highly flexible and partly thin aluminum strip, mounted in conjunction with a flexible cable that connects lever 84 to a tension spring 85 by way of a cable 82. Spring 85 will also become fatigued and break after extended use. The process of removing cable 37 with piston 13 and cable 82 along with lever 84 and stop ring 14 found in FIG. 1 (U.S. Pat. No. 2,815,142) is well known in the industry and are standard procedure in the maintenance and upkeep of the apparatus. Another disadvantage with this design includes the physical pain that can be encountered by the technician after prolonged wrist engagement with lever 84 by providing continued corner wheel pressure during the angular taping process.

FIG. 15 (U.S. Pat. No. 2,815,142) provides a graphic representation of the working relationship between the compound supply that is specified as the reservoir in the drawing along with the hand pump 135 and the automatic taper tool 12 during the filling process. The handle 136 is physically manipulated in an up and down motion to transfer drywall compound from the reservoir tank through the pump 135 into the automatic taper 12 resulting in barrel 10 being filled with drywall compound.

U.S. Pat. No. 5,611,243 Provides a new method for advancing the material plunger along the supply tube of an automatic tape applicator. The present invention eliminates this apparatus entirely, making it irrelevant to the present invention. Other patents that are comprised of essentially the same structural components and integral shortcomings as those mentioned above include U.S. Pat. No. 7,624,782B2, US20110290422, U.S. Pat. Nos. 10,569,292B2, 10,195,636B2, and 4,086,121.

Continuous Flow System (CFS) Tools

U.S. Pat. No. 4,127,434 patent assigned to Corban Industries FIG. 6 specifies item 32 that is the normally open single acting air cylinder that is contracted under air pressure in its normal state of operation. Upon valve activation by the technician air pressure is discontinued to the air cylinder and a spring extends the corner wheel 31 via cable 33 allowing it to embed the paper tape into a drywall panel angle joint. The utilization of a spring to extend the corner wheel is an inherent shortcoming as a mechanical spring will weaken and lose tension over a period of use. The consequence of spring tension loss results in the paper tape not being embedded into the corner surface sufficient enough to maintain adhesion with the angled drywall panels and causing the paper tape to often fall from the position of angled application. Upon further use the spring will eventually break.

Another inefficiency becomes evident when evaluating the pneumatic pressure of the mud valve arrangement in U.S. Pat. No. 4,127,434 FIG. 13. The use of a double acting cylinder 92 to control the flow of drywall compound is not required and results in an unnecessarily expensive design.

Another area in that this design can be improved is in the pressing action of the thumb by the technician upon the actuators to activate the various pneumatic operations such as cutting the tape, providing a flow of drywall compound onto the tape, activating the corner wheel, and advancing a new piece of tape through the taping head after the previous piece of tape has been severed from the roll. In this application thumb activation does not provide the best ergonomic means for activating a pneumatic cylinder and often results in hand and wrist pain.

U.S. Pat. Nos. 4,105,490, and 4,208,239 are all factional improvements to the same pneumatically supplied taping applicator assigned to Corban Industries that was mentioned in the previous description of U.S. Pat. No. 4,127,434 above with each taper featured in the patents having the same shortcomings as have been previously stated.

U.S. Pat. No. 7,621,309B1 is titled Pneumatic Drywall Taper and defines itself as "a drywall taper that includes a hollow storage body for holding a supply of drywall compound, and a movable plunger disposed within the storage body and engageable with the drywall compound. An applicator head is connected to a top end of the hollow storage body with the applicator head having a drywall compound passage formed therein." Air pressure is injected against the rear side of the movable plunger opposite of the drywall compound contained in the forward end of the hollow storage body. As pressure is applied to the rear side of the plunger drywall compound is dispensed forward in the taping head and onto the tape before being applied to the drywall panel surface.

FIG. 11 in U.S. Pat. No. 7,621,309B1 provides an illustration portraying the physical components of the mechanical corner wheel assembly as mounted to the applicator head. Engagement of the corner wheel 106 is provided by means of a hand operated sliding sleeve FIG. 1 (U.S. Pat. No. 7,621,309B1) item 34 that rides in an external relationship being circumferentially disposed upon the storage body 14. The tape advancing mechanism and tape severing functions are engaged by the forward gliding motion of the sliding sleeve.

A significant fault with the design occurs when the tape that has been applied into an angular joint pulls away from the corner and falls to the floor. This can happen when the corner wheel is unable to make full contact with the tape and is thus incapable of embedding the tape properly. With the inventions requirement to manipulate the sliding sleeve forward to extend the corner wheel, it limits the overall reach of the corner wheel since the full extension of the corner wheel when measured from the floor is limited to the over head reaching height of the technician's hand being engaged with the sliding sleeve in the upper one third section of the apparatus. As a result the overall height of the creaser wheel is much lower than a standard automatic tape applicator where the technician engages the corner wheel system at the rearward most portion of the automatic tape applicator and is able to lift the contact point of the corner wheel much higher by pushing upward from the further most location away from the corner wheel while the opposite hand is also engaged with the taper at a lower position on the apparatus than with this design.

Still another short coming occurs with the unnecessary activation of the tape advance mechanism when additional tape is not required such as reaching out to use the corner wheel as a pushing member to reattach tape over a drywall panel joint that may pull loose before it falls from the joint and onto the floor of the working area. Unnecessary activation of the tape advance mechanism when only wanting to engage the corner wheel results in an avoidable length of tape being expelled from the taper when it is unintended to apply to a panel joint. In addition the needless employment of the advance mechanism creates premature wear and shortened life of the components that comprise the tape advance mechanism.

Claim 17 of U.S. Pat. No. 7,621,309B1 contains a section that entails, "... a delivery tube disposed in the storage body for delivering drywall compound completely therethrough, the delivery tube having a first end connected to a drywall compound supply assembly fed directly by a source of pressurized drywall compound, and a second end opposite the first end connected to and in communication with the applicator head;" In FIG. 18 (U.S. Pat. No. 7,621,309B1) an internal delivery tube 222 is provided to transfer drywall compound from a source of pressurized drywall compound through a handle for controlling the admission of pressurized drywall compound therethrough (as stated in claim 21 of U.S. Pat. No. 7,621,309B1). The delivery tube illustrated in U.S. Pat. No. 7,621,309B1 is located internally of the storage body being mechanically affixed to a solid adapter end 226 at its rearward end and at its forward end at a tubular feed adapter 240 that is affixed to the applicator head 22. Pressurized drywall compound is supplied by source 238 through supply line 236 and is fed to in-line valve 232. The handle 234 on in-line valve 232 acts as an on/off and volume control to selectively allow a volume of drywall compound flow at a certain pressure as dictated by needle valve control 230 to move through the apparatus 10'. For this specific device, drywall compound 28 (FIG. 19 U.S. Pat. No. 7,621,309B1) entering the in-line valve 232 at 2,000-3,000 pound per square inch will be stepped down by the internal restriction in the needle valve 228 to a pressure of at least 40-50 pounds per square inch. In FIG. 19 (U.S. Pat. No. 7,621,309B1) the pressurized drywall compound 28 then flows substantially continuously through live swivel 224 (FIG. 18 of U.S. Pat. No. 7,621,309B1), the delivery tube 222 and the feed adapter 240 to applicator head 22. Drywall compound flow entering the applicator head 22 is metered uninterruptedly through the passage 202 in the groove 244 (FIG. 20 U.S. Pat. No. 7,621,309B1) and plug 242 to discharge opening 218 until the handle 234 on in-line valve 232 (both featured in FIG. 18 of U.S. Pat. No. 7,621,309B1) is disengaged to stop the supply of drywall compound 28 (FIG. 19 of U.S. Pat. No. 7,621,309B1) from source 238 (FIG. 18 of U.S. Pat. No. 7,621,309B1).

Several shortcomings relating to this design are apparent. First, the overall design of this system and particularly the delivery tube 222 is in no way compatible with an automatic tape applicator known in the art as the delivery tube 222 is application specific as it is rigidly connected to a specific applicator head 22 (FIG. 20 U.S. Pat. No. 7,621,309B1) of this invention without the ability to be used in any other mounting configuration. In addition as this design is configured to be operated within a transparent body, if the delivery tube 222 were implemented within a standard automatic tape applicator having an aluminum storage body there would be no visible means to determine if drywall compound were leaking past the mating surfaces of the tubular feed adapter 240 as the adapter end 226 (both featured in FIG. 18 U.S. Pat. No. 7,621,309B1) is comprised of solid construction and sealed around its circumferential edge with the internal side of the storage body 14. In a situation where leaking occurred at the tubular feed adapter 240, the excess material would be contained within the internal area of the storage body 14 with no method of escaping. As this area continued to fill with drywall compound the apparatus 14 would become heavier making it more difficult to operate. Over a period of time the drywall compound that leaked into the air filled internal cavity of the apparatus would dry and harden due to its contact with the captive air. In addition the increased air pressure that would be created because of the leaking drywall compound into a captive area, could push air back through the leak and into the general flow of drywall compound in the taping head 22. Such air would create bubbles in the compound leaving areas on the tape without any drywall compound on the body of the tape being applied. This condition is referred to as a blister and requires the technician to stop the taping process, remove the blistered tape, reapply drywall compound and wipe the tape onto the drywall surface in a manner that leaves enough compound between the tape and the drywall joint to ensure adherence after drying.

In addition metering plug 242 is unnecessarily expensive to produce and provides a more complicated design than is necessary. Another shortcoming with this design involves the handle 234 operating in conjunction with inline valve 232 has no ability to interact with the process of extending the corner wheel. Another shortcoming is the method by which the flow of drywall compound is restricted using the needle valve control is unnecessarily expensive and can be accomplished in a more efficient manner.

U.S. Pat. No. 1,829,479 is a hose supplied spreading applicator for old style plaster that was invented before the concept of drywall taping was conceived. It's material hose connects one end to a screw pump powered by an electric motor that forces plaster from its hopper and through the hose afterward flowing through a handle and then into a spreading device with an open internal passage that is hand manipulated across a wall or ceiling surface where the plaster is to be applied. An electrical switch is utilized in conjunction with an electrical conductor by way of a mounted relationship to the handle of the spreading device to control material flow.

The electrical conductor that is attached to the switch is routed at its opposite end to the electric motor and connected to its circuit. This invention has no practical ability to be used in conjunction with an automatic tape applicator.

U.S. Pat. No. 2,323,963 is a hose supplied tape applicator that was invented by R. G. Ames who was also the first inventor of the automatic tape applicator that was outlined above. FIG. 1 (U.S. Pat. No. 2,323,963) specifies the general construction and location of a manual cutting mechanism indicated generally at D. To cut the tape the technician pulls knob 34b causing knife 31 to be drawn across a perpendicular path of the tape severing the material. Mud valve 29 is a manual valve operated by the fingers of the technician. This early taper has no tape advancing function nor corner wheel apparatus to fold paper tape into an angular fitment. The invention lacks any functional capability to supply drywall compound to an automatic tape applicator used today.

U.S. Pat. No. 2,502,499 is the second hose supplied tape applicator invented by R. G. Ames. This version incorporates a rotatable disc 74 mounted on an arm 57 at 75 notated in FIG. 11 (U.S. Pat. No. 2,502,499) to crease the tape when actuated by pulling on the L shaped arm 61 (FIG. 3 U.S. Pat. No. 2,502,499). Lever 21 (FIG. 2 U.S. Pat. No. 2,502,499) supplies tape to the end of the tool. Valve 9 is opened (FIG. 1 U.S. Pat. No. 2,502,499) to close the circuit from the battery 56 to the motor 52 that rotates the gear pump 50 to deliver mastic under pressure to supply mastic through the apparatus and onto the tape. Lever 32 FIG. 2 (U.S. Pat. No. 2,502,499) cuts the tape. While this invention was the height of drywall technology at its time it has no relevance nor compatibility with the automatic tape applicator referred to in the present invention.

U.S. Pat. No. 3,116,195 by Wesley D Lathrop and Alfred Castle is a hand operated tape applicator that utilizes various levers and valves to operate a hose supplied drywall tape applicator. It's noted that in FIG. 5 (U.S. Pat. No. 3,116,195) a manual valve 60 is provided with a control handle 64 and a material screw adjustment 66 for facilitating the manual flow from the mud supply hopper identified as 46 in FIG. 2 (U.S. Pat. No. 3,116,195) to the dispensing means 62 identified in FIG. 4 (U.S. Pat. No. 3,116,195) by way of hose connector 58 identified in FIG. 1 and FIG. 3 (each illustrated in U.S. Pat. No. 3,116,195). FIG. 1 (U.S. Pat. No. 3,116,195) also identifies corner wheel lever 162 that is pulled in a rearward motion to engage a corner wheel 166 identified in FIG. 4 (U.S. Pat. No. 3,116,195) with the first face 42 of tape 21 opposite to where tape is applied to a drywall panel joint as identified as 14 FIG. 1 (U.S. Pat. No. 3,116,195). When the technician 12 draws the handle 114 (seen but not identified in FIG. 1 U.S. Pat. No. 3,116,195 and is identified in FIG. 6 (U.S. Pat. No. 3,116,195) rearwardly, a blade 78 identified in FIG. 4 (U.S. Pat. No. 3,116,195) is projected through the opening 120 so as to sever the tape forward from the tape supply roll 20 identified in FIG. 5 (U.S. Pat. No. 3,116,195). The technician then pushes forward on the handle 114 so as to allow the spring portion 138 identified in FIG. 4 (U.S. Pat. No. 3,116,195) to eject the tape 21 that is still integral with the supply roll 20 FIG. 5 (U.S. Pat. No. 3,116,195) through the chute defined by plates 30 and 32 into engagement with the roller 40 past the mud dispensing means 62. This allows the technician to begin a new application of drywall tape onto the surface of another joint. Though this system has the ability to operate the flow of mud through a hand held device, it has no mechanical ability to operate in conjunction with an automatic tape applicator.

U.S. Pat. No. 4,080,240 is a hand held drywall tape applicator that is connected to the end of a hose by which manual levers are manipulated to provide a process that governs the application needed to install drywall tape to a wall, ceiling or angular surface. It has no relevance to the purpose of the present invention and is unable to work in any capacity with an automatic taping device.

U.S. Pat. No. 6,209,609B1 provides a pole mounted apparatus designed to apply sheeting material to a surface. There is no availability within its structure to also apply drywall compound to the tape or sheeting material before it is applied to a joint surface. In the drywall trade there is an occasional requirement to apply adhesive backed fiberglass mesh tape to a joint surface. This invention could be very conducive to that purpose but not in any way is it compatible with the working functions of an automatic drywall tape applicator.

U.S. Pat. No. 6,294,034B1 is manual tape applicator that is mounted at the end of a hose with its tape roll being fitted to the waist of the technician. Apparently its purpose was to provide a low cost tool without the need to be refilled. It has no means of functional compatibility with an automatic taping device.

U.S. Pat. No. 6,540,856B2 is another hand held taping device that has manual apertures designated to provide functions required to cut the tape, advance the tape remaining in continuous relationship to the tape supply roll, apply drywall compound to the tape and thus providing another method to apply drywall tape to a joint surface. It has no functional ability to operate in conjunction with an automatic taping device.

U.S. Pat. No. 8,863,807B2 provides an improved corner wheel operation that functions within a self contained drywall tape applicator providing a hose supplied cylinder that utilizes an outer sleeve to cut and advance the drywall tape before the tape is applied to the joint surface in a manner very similar to the standard automatic taper. Likewise it provides a manually levered corner wheel to embed the tape into angular surfaces. This invention is an entire replacement for the manually filled automatic drywall tape applicator that is used in the drywall field today. It provides expensive design option for replacing the continual manual refilling process of the standard automatic taper. As it is a complete replacement for the automatic tape applicator the technician must discard his refillable automatic tape applicator as it then becomes obsolete and of no practical use or financial value. The various operational functions that are utilized with this invention are each engaged through direct manual pressure applied to the inventions separate levers or to its sliding member, each receiving operational pressure in direct proportion to the amount of physical pressure that is provided by the technician. Concisely stated, the more pressure the technician provides to the various levers or to its sliding member, the more pressure the actuated function receives. This results in a fluctuating consistency in the taping process as the technician slows down becoming more fatigued as the work day progresses. Claim 12 states, " . . . wherein said first actuator and said second actuator are adapted for simultaneously receiving user input from a single hand of a user." The stated first actuator of the claim controls the flow of drywall compound onto the tape and the second actuator provides linear function to the corner wheel mechanism. This claim of U.S. Pat. No. 8,863,807B2 is specifically negated by the single hand operable control functions provided in 1978 when Harold M. Lass was granted patent U.S. Pat. No. 4,127,434. In the Lass patent he has clearly specified the use of a pneumatic control system that is operated by a single hand of the technician that provides access to various actuators that are used to perform the taping process. Within the Lass patent (U.S. Pat. No. 4,127,434) under the section titled, "Description Of The Preferred Embodiments" in paragraph 4 beginning in its second sentence it clearly states that, "Suitable thumb operated valves 29 are disposed at the outer end of the main body 12 for operation by the technician for controlling certain functions of the taping tool 11. One valve controls the flow of dry wall cement from the tank 19 to the applicator head 14. Another valve controls air pressure to a pneumatic cylinder for operating the shear and for advancing the leading end of the tape 16. Another valve controls air pressure to a second pneumatic cylinder 32 for operating a cornering wheel 31." The Lass U.S. Pat. No. 4,127,434 continues to state the relevant location of the actuators being operable by the technicians single hand in the following claims. Claim 4. "The apparatus of claim 3 including second control means carried from said body means and responsive to manual actuation by the technician for controlling the flow of dry wall cement through said cement conduit means between said container means and said dry wall cement dispensing means."

Claim 10 states: "The apparatus of claim 1 including cornering wheel means pivotably carried from said body means for folding the tape into a corner seam, second pneumatically powered means for selectively pivoting said cornering wheel means into operating position, means for supplying pneumatic power to said second pneumatically powered means, and second control means carried from said body means and responsive to manual actuation by the technician for controlling the supply of pneumatic power to said second pneumatically powered means and hence for controlling operation of said cornering wheel means." Claim 11 states: "The apparatus of claim 10 wherein said second pneumatically powered means comprises a pneumatically powered actuating cylinder having a piston movable therein in response to pneumatic power supplied to one side of said piston within said cylinder." FIG. 13 (U.S. Pat. No. 4,127,434) provides a graphic representation of the rearward locations of the cornering valve 29, the mud valve 29 and a shear valve 29 (each using the same designation number 29) within the reach of the technicians' thumb when holding the device as is shown in FIG. 1 of U.S. Pat. No. 4,127,434. Numerical actuator locations are also noted in the rearward most area of the invention as can be viewed as item 29 in FIG. 13 (U.S. Pat. No. 4,127,434) and also in the operational arrangement of the technician and the invention in FIG. 1 (U.S. Pat. No. 4,127,434). This invention is handicapped in efficient operation as evidenced in U.S. Pat. No. 4,127,434 FIG. 13 by the double acting mud air cylinder 92 as it is more expensive to manufacture than an integrated spring closing control valve. Also providing full pneumatic pressure to engage cornering valve 29 which retracts the corner cylinder 32 as shown in FIG. 6 (U.S. Pat. No. 4,127,434) thereby withdrawing the cornering wheel via cable 33 against its associated spring force can cause the corner wheel to push the taping apparatus away from the drywall joint.

U.S. Pat. No. 9,481,000B2 is a manual flow lever used in conjunction with a hose fed material supply source that supplies various attachments known in the drywall trade. A similar approach is utilized in U.S. Pat. No. 7,621,309B1 as stated above. Both U.S. Pat. Nos. 9,481,000B2 and 7,621,309B1 are functionally incompatible with an automatic drywall tape applicator.

U.S. Pat. No. 10,000,048B2 is titled, "A taping tool having improved tape advance." The system is unnecessarily expensive to manufacture and is functionally incompatible with an automatic drywall tape applicator as is common in the workplace today.

An additional shortcoming of CFS systems involves the chemical incompatibilities of drywall compound with various metal surfaces. Depending on the composition of the drywall compound it is common for the compound to cause pitting and surface reactions with an aluminum material. As different drywall compound manufacturers vary the different chemicals in their mixtures, some reactions are more prevalent than others.

Another unaddressed issue with continuous flow systems involves drywall compound leaking from the front passage of the taping device where the drywall compound is combined onto the paper tape just before application. The weight of the drywall compound within the supply line can leak from the supply line outward of the taper.

Another shortcoming with continuous flow systems that use pneumatically operated components is that they provide no protection against foreign matter invading the internal functional components of the system such as linear actuators or the valves that are used to provide pressure to the actuators. Pneumatic valves contain vent channels to allow air to flow into the component which eliminates an internal vacuum which would negatively affect the operation of the valve as it moves between various positions. Other valves provide passageways to internally exhaust air from another component to escape its body directly to atmosphere. Since construction tools are used in dirty environments abrasive elements can come in contact with the inner components of pneumatic mechanisms through these passageways. This is especially the case in the drywall industry as the gypsum which is used in drywall panels and drywall compound can be very abrasive on a microscopic level. When the technician washes the tools water can combine with these abrasive elements and find its way into the pneumatic valving and linear actuators causing the activations to slow down due to build up from foreign matter and wear out in a much more rapid manner.

Other

U.S. Pat. No. 5,535,926 is a single acting drywall pump utilizing air pressure from a remote source to apply drywall compound to a drywall surface. Claim 2 states, "The apparatus of claim 1, wherein the mastic directing means is a wand having a receiving port to receive the mastic from the pump, the wand having a nozzle in communication with the receiving port so that the mastic can flow out of the wand and onto the selected surface." While the apparatus does provide a method of attachment to a nozzle in communication with a mastic supply, there is no capacity to regulate the flow of mastic from the apparatus nor is there an ability to apply tape to the joints located between drywall panels and has no relevance to the present invention.

U.S. Pat. No. 6,712,238B1 and U.S. Pat. No. 6,299,686B1 are both inventions of the essentially same idea. With both inventions there is no ability to be mounted in conjunction with an automatic drywall tape applicator.

In addition to the previously mentioned shortcomings another disadvantage results when the technician is forced to operate the manual pump by bending down to mount the automatic drywall tape applicator to the pump and then manually engage the pump by pulling up and pushing down on the pump filling handle until the tape applicator is refilled with drywall compound. This pumping action results in arm and back fatigue and frequent overall body pain at the end of a working day. While the manual operations inherent to the use of an automatic tape applicator cause fatigue, the greatest source of strain on the technician results from the overall weight of the automatic drywall tape applicator when it is filled with drywall compound and lifted overhead for ceiling application, lowered for lower wall joints and manipulated into a variety of ceiling and wall corners on a continual basis. Extensive strain is especially felt upon the technicians' body when applying tape in very small areas such as closets and under stairways with the full weight of a filled automatic taper. An additional problem with every previously stated patent is that there is no current means of attaching a material hose to provide drywall compound to a standard automatic drywall tape applicator and eliminate the need to refill the unit. This results in a complete loss of value to the technician as he or she is forced to disrupt the taping process to go back to the pump and refill the unit.

Another significant problem with an automatic drywall tape applicator is the mounted cable and plunger assembly that is contained within the taper and is pulled along the interior surface of the material reservoir sleeve to dispense drywall compound onto the paper tape near the point of application. This cable will break several times over the life of the automatic drywall tape applicator causing downtime and requiring replacement. Likewise the seal mounted to the plunger assembly will wear and leak requiring similar replacement after a period of use.

Another disadvantage with the automatic drywall tape applicator is the requirement for the technician to manually engage the corner wheel trigger throughout the tape application process that adds fatigue and strain to the users forearm, fingers and wrist.

Another disadvantage of the automatic tape applicator is that the only way to reduce the time required to accomplish the taping and smoothing process is to purchase a completely separate taping technology by way of a hose supplied material system that attaches to single source taping and smoothing devices designed specifically to operate within the parameters of the new manufacturers particular pumping system. With the hose supplied options each manufacturer mates their own hose supplied methods to their specific set of tools so that no other manufacturers hose will connect to their or any another manufacturers sole source taping device.

Another disadvantage with the automatic drywall tape applicator is the need for additional training time to learn how to operate a completely new technology as is required with a hose supplied tool system.

In addition to the previous shortcomings stated with CFS drywall taping systems is the need to provide a chemical barrier on the interior surfaces of a hose supplied taper so as to insulate the taper from chemical imbalances that result in oxidation, pitting, and comparable surface imperfections that may occur such as when drywall compound is in continual contact with unprotected aluminum or other metallic surfaces.

Thus, it would be desirable to provide a supplementary system capable of being mounted to a standard automatic drywall tape applicator that fulfills the following requirements and overcomes some or all of the aforementioned shortcomings;

a) Provide a supplementary device that eliminates the requirement to refill the automatic drywall tape applicator by manually pumping drywall compound into the apparatus.
b) Provide a supplementary device that eliminates the requirement for a cable and plunger assembly within an automatic drywall tape applicator.
c) Provide a common method of attachment between a hose supplied material source and an automatic drywall tape applicator.
d) Provide a supplementary device that can be mounted to an automatic drywall tape applicator by way of its material reservoir sleeve.
e) Provide a supplementary device capable of supplying a continual source of drywall compound and linear mechanical function to a standard automatic drywall tape applicator utilizing pneumatic pressure.
f) Provide a supplementary device that reduces the weight of an automatic drywall tape applicator by use of a lesser sized internal material conduit fitted within the material reservoir sleeve of an automatic drywall tape applicator having various supporting means capable of creating a fluidic seal between the supplementary device and the internal circumferential surface of an automatic drywall tape applicator.
g) Provide a means to support an internal material conduit having vented access being provided at one or more locations within an automatic drywall tape applicator.
h) Provide a supplementary device that eliminates the requirement for a manually operated corner wheel trigger assembly.
i) Provide an extension and retraction corner wheel device capable of eliminating the requirement for the return spring used on a standard automatic drywall tape applicator.
j) Provide a pneumatic signal that mobilizes a single acting pneumatic compound actuator causing an open state within the actuator to allow a flow of drywall compound that is combined with the utilization of a spring to return the actuator to a closed position upon the discontinuation of the pneumatic signal.
k) Provide a means of ergonomic control whereby a pneumatic actuator is engaged by the technician in a pulling motion.
l) Provide a means of surface protectant on the interior area of a drywall compound supply tube to insulate the supply tube from impending chemical degradation.
m) Provide a means by which the weight of the drywall compound is retained within the supply tube by the utilization of surface tension being created between the drywall compound and the supply tube.
n) Provide a system which is not vulnerable to contamination of pneumatic mechanisms by way of foreign matter invading the system through venting or exhausting passages.

Features and Advantages

It is therefore an advantage of the present invention to provide a device that eliminates the requirement to refill an automatic drywall tape applicator by manually pumping drywall compound into the apparatus.

An additional advantage of the present invention is to eliminate the cable and plunger assembly from an automatic drywall tape applicator.

A further advantage of the present invention is to provide a common method of attachment between a remote drywall material source and an automatic drywall tape applicator.

A further advantage of the present invention is to provide a supplementary device which contains an ergonomic control system that can be mounted to an automatic drywall tape applicator in a manner being capable of removal to allow full use of an automatic drywall tape applicator as originally configured.

Another advantage of the present invention is to provide a supplementary device capable of supplying an ergonomic control system that is capable of operating various functions of an automatic drywall tape applicator.

Another advantage of the present invention is to provide a supplementary device capable of supplying a continual source of drywall compound utilizing pneumatic pressure that is capable of being mounted in unison with the structure of a standard automatic drywall tape applicator.

A further advantage of the present invention is to reduce the weight of an automatic drywall tape applicator during its functional operation by use of a lesser diameter sized internal material conduit fitted within the material reservoir sleeve having a solid bodied supporting means mounted in conjunction with a supporting means being externally sealed.

A further advantage of the present invention is to reduce the weight of an automatic drywall tape applicator during its functional operation by use of a lesser diameter sized internal material conduit fitted within the material reservoir sleeve of an automatic drywall tape applicator having externally sealed and internally vented spacer supports.

An additional advantage of the present invention eliminates the need for the manually operated corner wheel trigger lever assembly that is provided with a standard automatic drywall tape applicator.

An additional advantage of the present invention incorporates an ergonomically actuated pneumatic valve that provides direct physical engagement with a means to provide regulated pressure for the purpose of operating the extension function of a corner wheel assembly.

An additional advantage of the present invention incorporates air pressure to return a corner wheel assembly to a position where the corner wheel is located some distance from its extended position. A further advantage of the present invention is to provide a single acting pneumatic actuator that activates a compound actuator causing an open state allowing a flow of drywall compound that is combined with the utilization of a spring to return the valve to a closed position upon the discontinuation of pneumatic pressure that is applied to the actuator.

A further advantage of the present invention is to provide a means of ergonomic control whereby a pneumatic actuator is engaged by the technician in a manner that allows for a pulling upon an actuators means of engagement whereby the act of depressment is engaged by the finger or fingers of the drywall technician in a pulling motion.

A further advantage of the present invention is to provide a supply tube that contains a surface protectant that insulates the drywall compound chemical incompatibilities from the interior surfaces of the supply tube.

A further advantage of the present invention is to provide a means of increased surface tension between drywall compound and a supply tube.

These advantages and others are achieved by way of an automatic drywall tape applicator system comprising generally of cylindrical fastening bands, a structural mounting capable of supporting various pneumatic actuators, a secondary structure to support a linear actuator for corner wheel activation, a pneumatic actuator mounted force regulator, a corner wheel strap with attachment means to a linear actuator corner wheel activation, an internal supply tube and a pneumatic controlled compound control valve.

Further areas of improvement realized in the present invention will become apparent from the detailed description provided hereafter. It should be understood that the detailed description and the specific examples, while indicating the preferred embodiment of the present invention, are intended for purposes of illustration only and are not intended to limit the scope of the present invention.

SUMMARY OF THE PRESENT INVENTION

A supplementary device which contains an ergonomic control system that provides for the utilization of a remote material source to supply drywall compound to an automatic drywall tape applicator.

BRIEF DESCRIPTIONS OF THE DRAWINGS OF THE PREFERRED EMBODIMENTS OF THE PRESENT INVENTION

The present invention will become more fully understood from the detailed description and the accompanying drawings, wherein.

Figure 19:
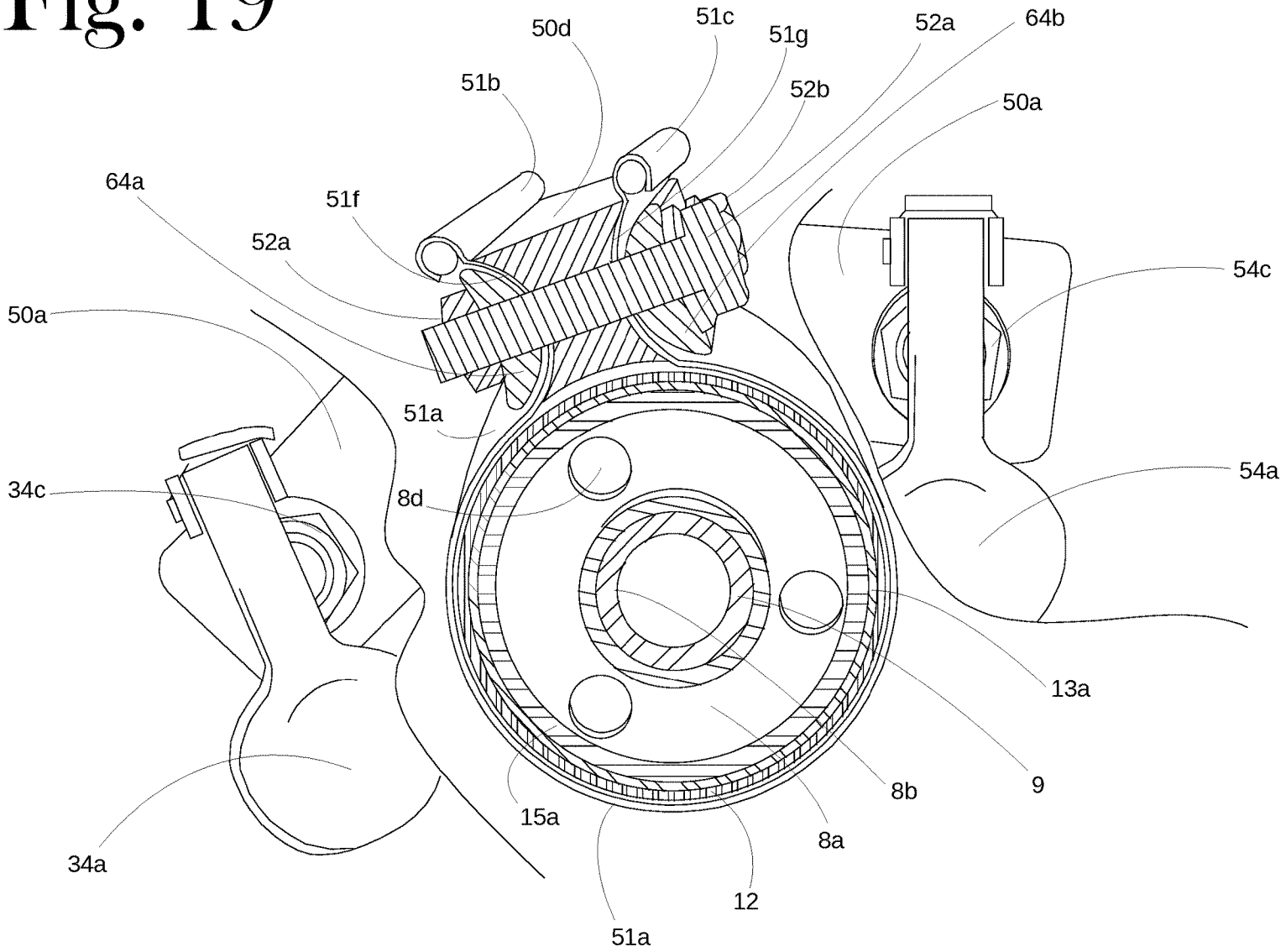

FIG. 19 is a section perspective from the rearward end of the present invention providing a view of the rearward vented supply tube centering guide and its adjoining parts illustrating the mounting relationship between the pneumatic actuator support bracket, the pneumatic actuator support bracket band, and similarly relevant components of the present invention positioned within and surrounding the material reservoir sleeve of an automatic tape applicator.

Figure 20:
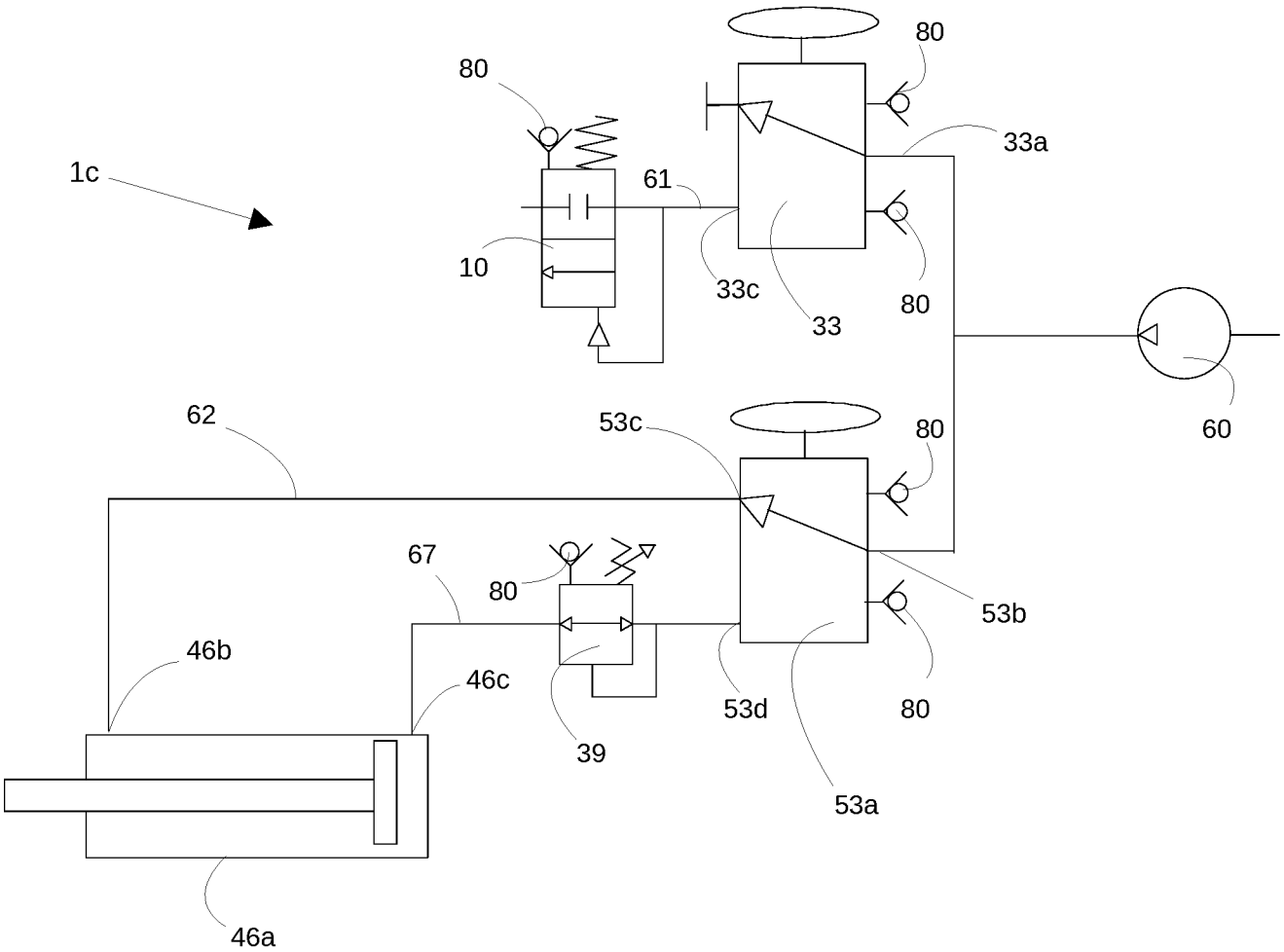

FIG. 20 is a schematic drawing of the present inventions ergonomic control system.

Figure 21:
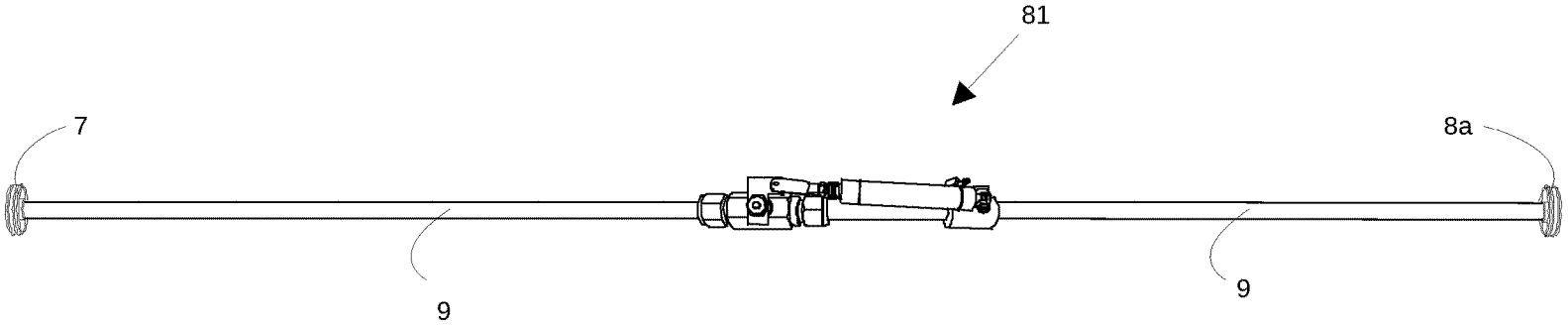

FIG. 21 is a perspective view of an alternative embodiment.

Figure 22:
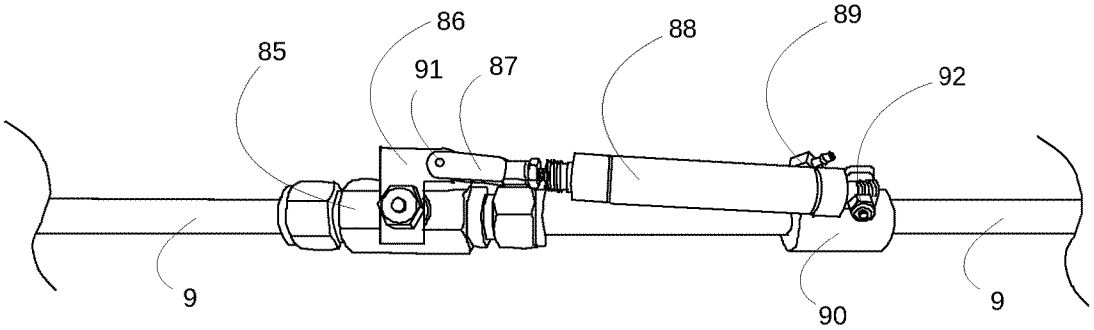

FIG. 22 is an enhanced view of an alternative embodiment.

DETAILED DESCRIPTION OF THE PREFERRED EMBODIMENTS OF THE PRESENT INVENTION

The present invention is a supplementary device that introduces an ergonomic control system with a means to deliver drywall compound through a manually operated automatic drywall tape applicator commonly known in the art. The following description is merely exemplary in nature and is in no way intended to limit the present invention, its application, or its uses.

Figure 1:
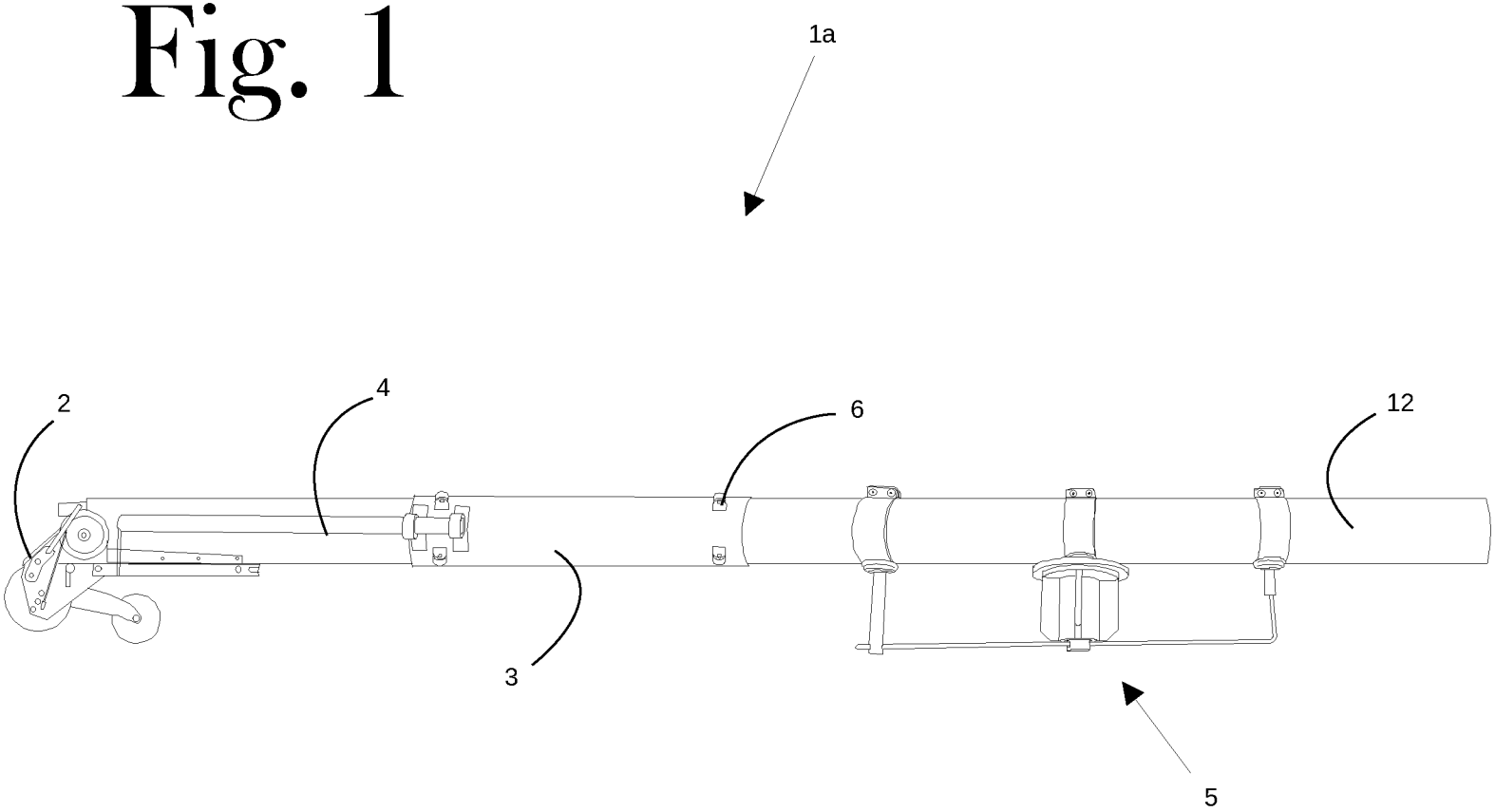
FIG. 1 is an external perspective view of a typical automatic drywall tape applicator prepared for mounting of the present invention having removed the corner wheel finger trigger assembly.

In FIG. 1, an automatic drywall tape applicator 1*a* comprises a taping head 2 located at the forward end of the apparatus. A material reservoir sleeve 12 is the main component of the structure by which all functional components of the automatic taper are mounted. An advance and cutting control handle sleeve 3 is engaged externally to said material reservoir sleeve 12 by way of a series of rollers 6. A control tube 4 is affixed to said control handle sleeve 3. A paper tape holding assembly 5 is mounted on the rearward section of said material reservoir sleeve 12.

Figure 2:
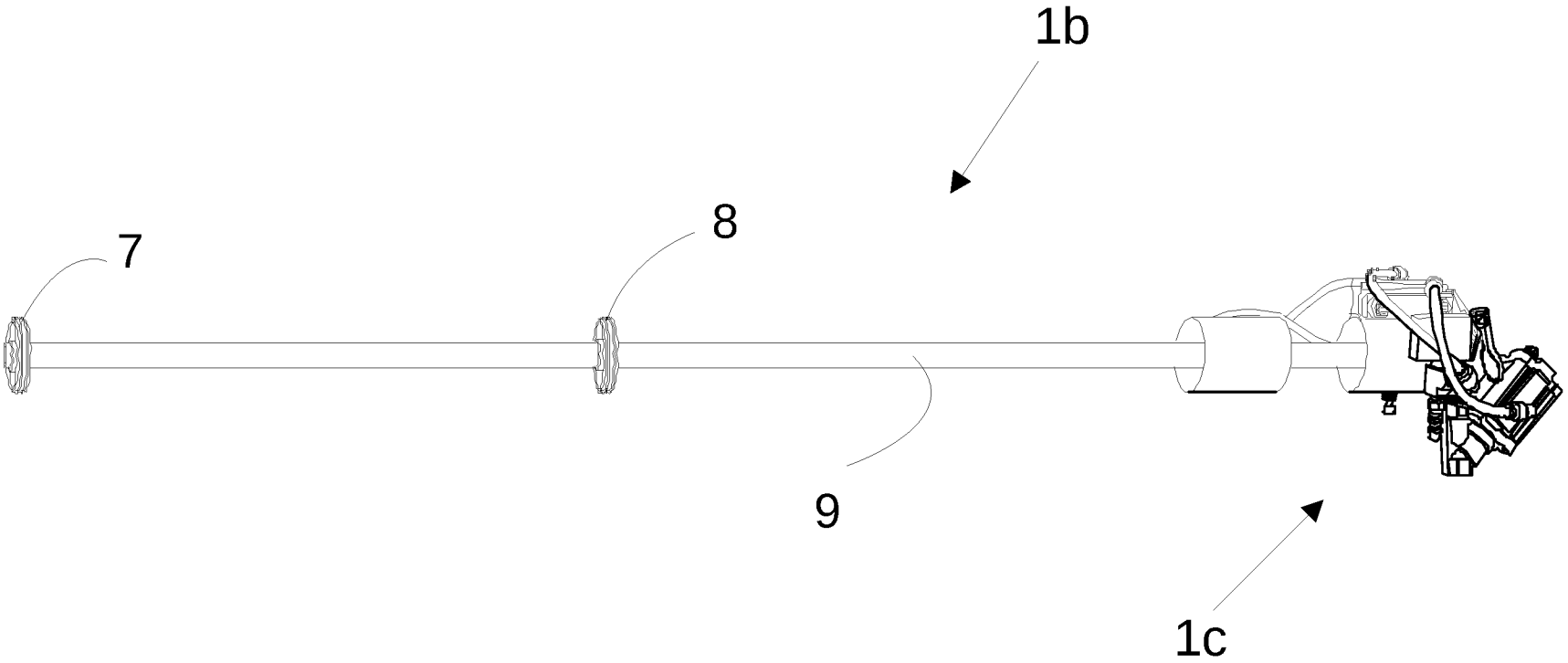
FIG. 2 is a perspective view of the primary structural features of the present invention.

FIG. 2 is a graphic representation of the present invention noted as 1*b* providing a forward mounted supply tube centering guide 7, a central vented supply tube centering guide 8 both of which support a supply tube 9. A rearward vented supply tube centering guide 8*a* is also provided though not seen in this view. More detailed representations of all three centering guides can be viewed in FIG. 3, FIG. 4, FIG. 5, FIG. 6 and in FIG. 7. 1*c* denotes an ergonomic control system that is provided in greater detail in subsequent sections and is also featured in FIG. 15, in FIG. 16 and also in FIG. 18 and in FIG. 19. Though not shown, supply tube 9 contains an internal surface coating.

Figure 3:
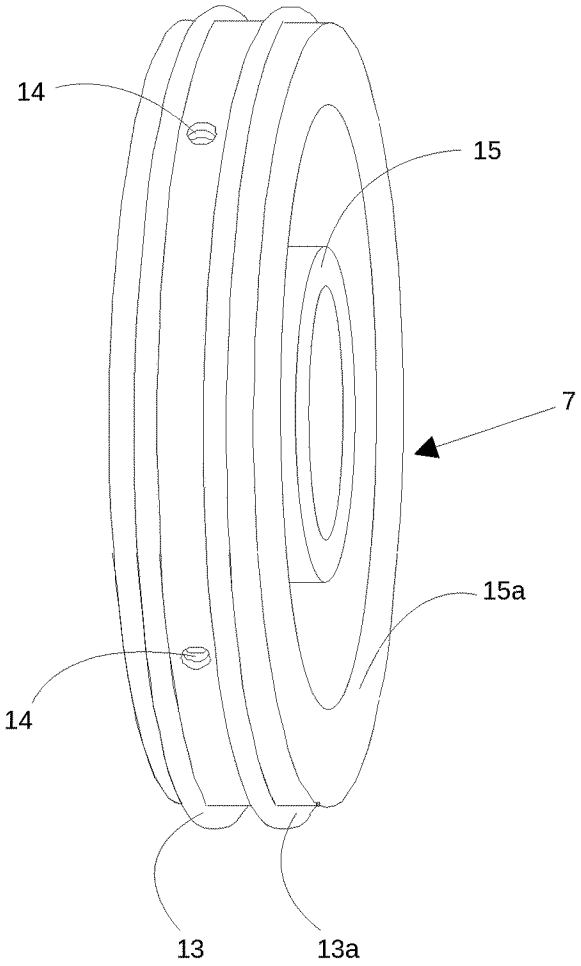
FIG. 3 is a view of the duplicate features common to 3 various tube centering guides 7, 8 and 8*a* described in subsequent sections of my specifications.
Figure 4:
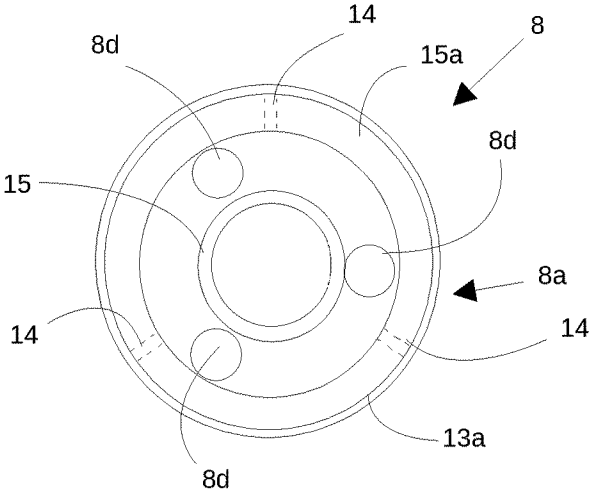
FIG. 4 is an end view of the common similarities of vented supply tube centering guides 8 and rearward vented centering guide 8*a* described in subsequent sections of the specifications.
Figure 6:
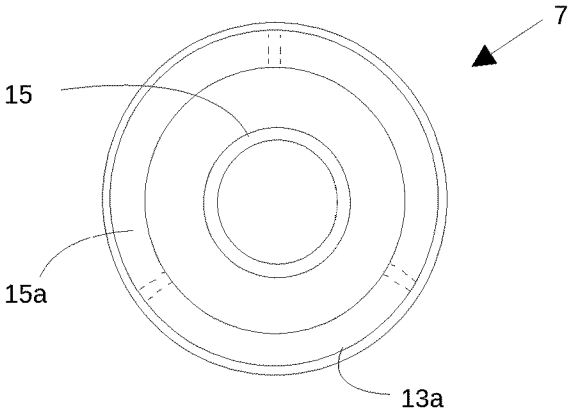
FIG. 6 is an end view of forward solid supply tube centering guide 7 described in subsequent sections of my specifications.

FIG. 3 specifically notates the locations of a primary sealing device 13, a secondary sealing device 13*a*, mounting apertures 14, mounting shoulder 15 and seal shoulder 15*a* which are common structural features of all three of the supply tube centering guides including the forward solid supply tube centering guide FIG. 6, item 7, the central vented supply tube centering guide FIG. 4, item 8 and the rearward vented supply tube centering guide FIG. 4 item 8*a*. The mechanical features of the central vented supply tube centering guide FIG. 4 item 8 and the rearward vented supply tube centering guide FIG. 4 item 8*a* are structurally similar.

In FIG. 4 the central vented supply tube centering guide 8 displays a plurality of internal vent passageways 8*d*. The mounting shoulder 15 is indicated centrally located within its structure with mounting apertures 14 also indicated within the body of the seal shoulder 15*a*. The secondary sealing device 13*a* is also depicted in the drawing.

Figure 5:
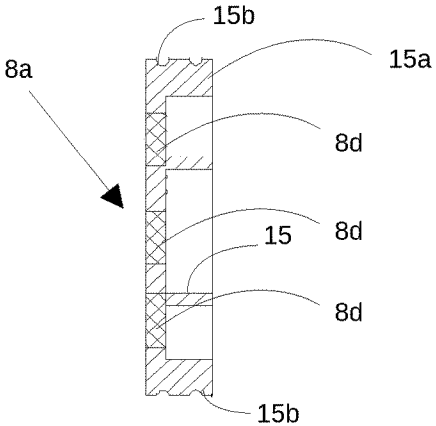
FIG. 5 is a side section view of vented supply tube centering guide 8 and rearward vented centering guide 8*a* described in subsequent sections of my specifications.

FIG. 5 refers to the rearward vented supply tube centering guide 8*a* with a section view featuring approximate locations of the internal vent passageways 8*d*, mounting shoulder 15 and seal shoulder 15*a* with the incorporation of seal grooves 15*b*.

FIG. 6 displays a rear perspective of the forward solid supply tube centering guide 7 identifying the location of the mounting shoulder 15 along with the seal shoulder 15*a* and a secondary sealing device 13*a*.

Figure 7:
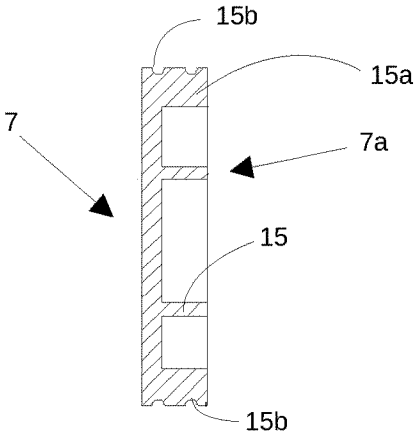
FIG. 7 is a side section view of forward solid supply tube centering guide 7 described in subsequent sections of my specifications.

FIG. 7 renders a side view of the forward solid supply tube centering guide 7 with a section perspective 7*a* notating the approximate locations of the mounting shoulder 15, the seal shoulder 15*a*, and approximate locations of the seal grooves 15*b*.

Figure 8:
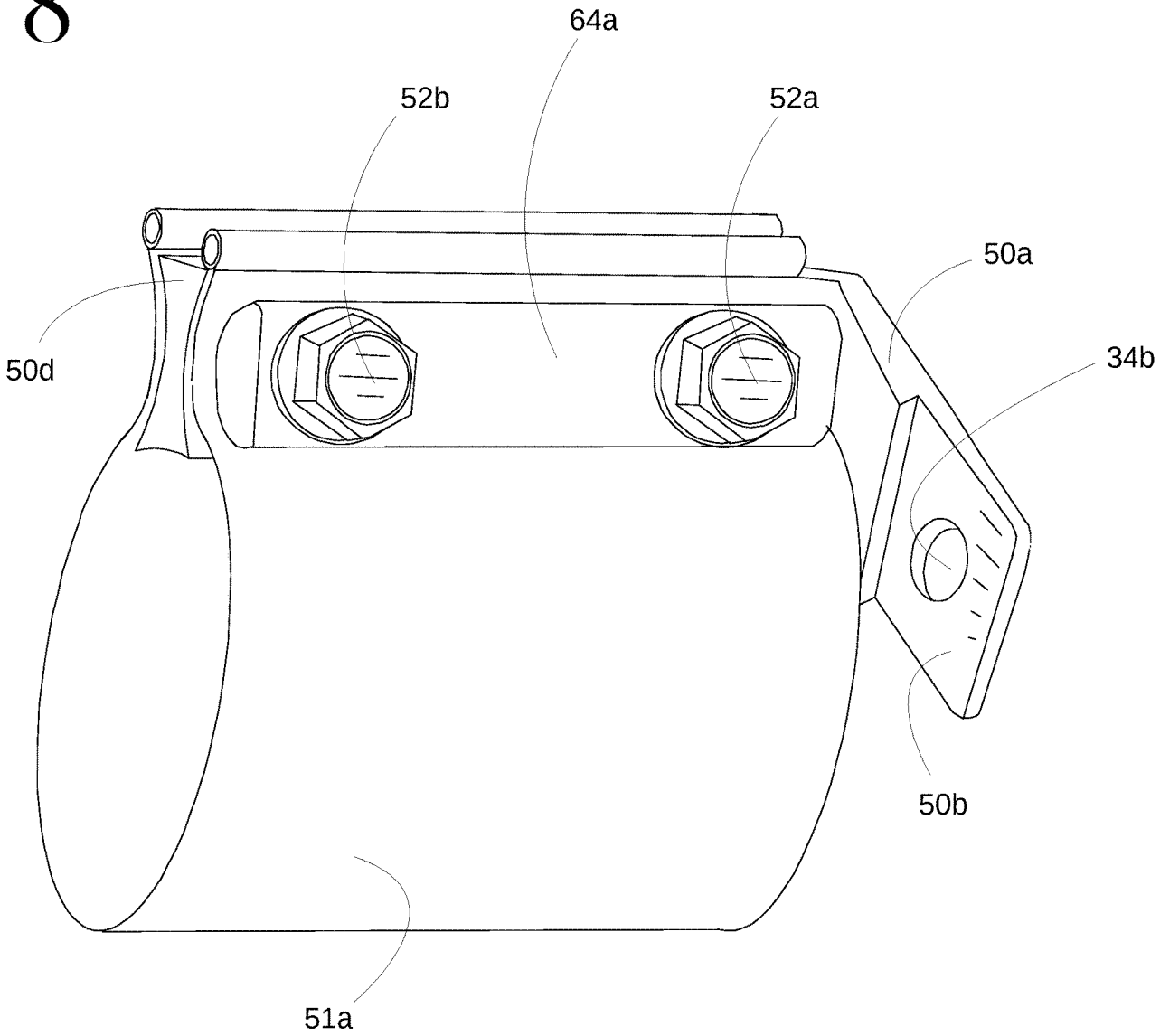
FIG. 8 is a perspective view of the pneumatic actuator support bracket in direct mounting relationship to the pneumatic actuator support bracket band.

FIG. 8 is a perspective view of a pneumatic actuator support bracket band 51*a* that is mechanically affixed to both sides of the support bracket mounting brace 50*d* by way of a securing bolt support one 64*a* through which a securing bolt assembly one 52*a* and a securing bolt assembly two 52*b* are being supported on the opposite side of the support bracket mounting brace 50*d* by a securing bolt support two 64*b* (seen in FIG. 19). Also noted in this view in the perpendicular relationship between the linear mounting orientation of the pneumatic actuator support bracket band 51*a* and the support bracket mounting brace 50*d* with a pneumatic actuator support bracket 50*a*, a first recessed supporting face 50*b*, and a first actuator mounting channel 34*b*.

Figure 9:
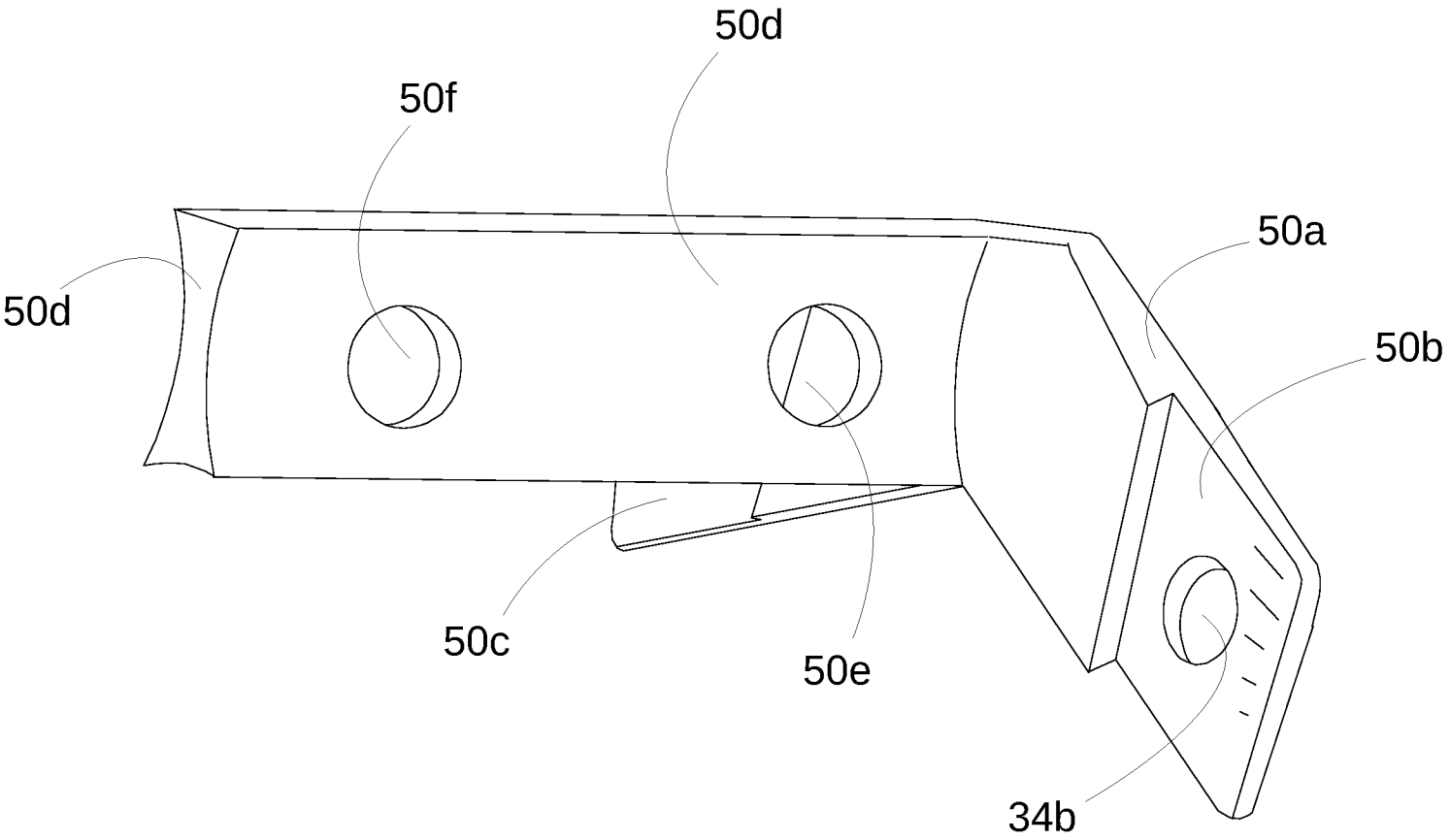
FIG. 9 is a side perspective view of the pneumatic actuator support bracket.

FIG. 9 points out specific features of the pneumatic actuator support bracket 50*a* having mechanical engagement with the pneumatic actuator support bracket mounting brace 50*d*. Within the body of the support bracket mounting brace 50*d* is a first mounting brace channel 50*e* and a second mounting brace channel 50*f*. The first actuator mounting channel 34*b* is observed in conjunction with the first recessed supporting face 50*b* within the pneumatic actuator support bracket 50*a*. A view of a second recessed supporting face 50*c* is also provided.

Figure 10:
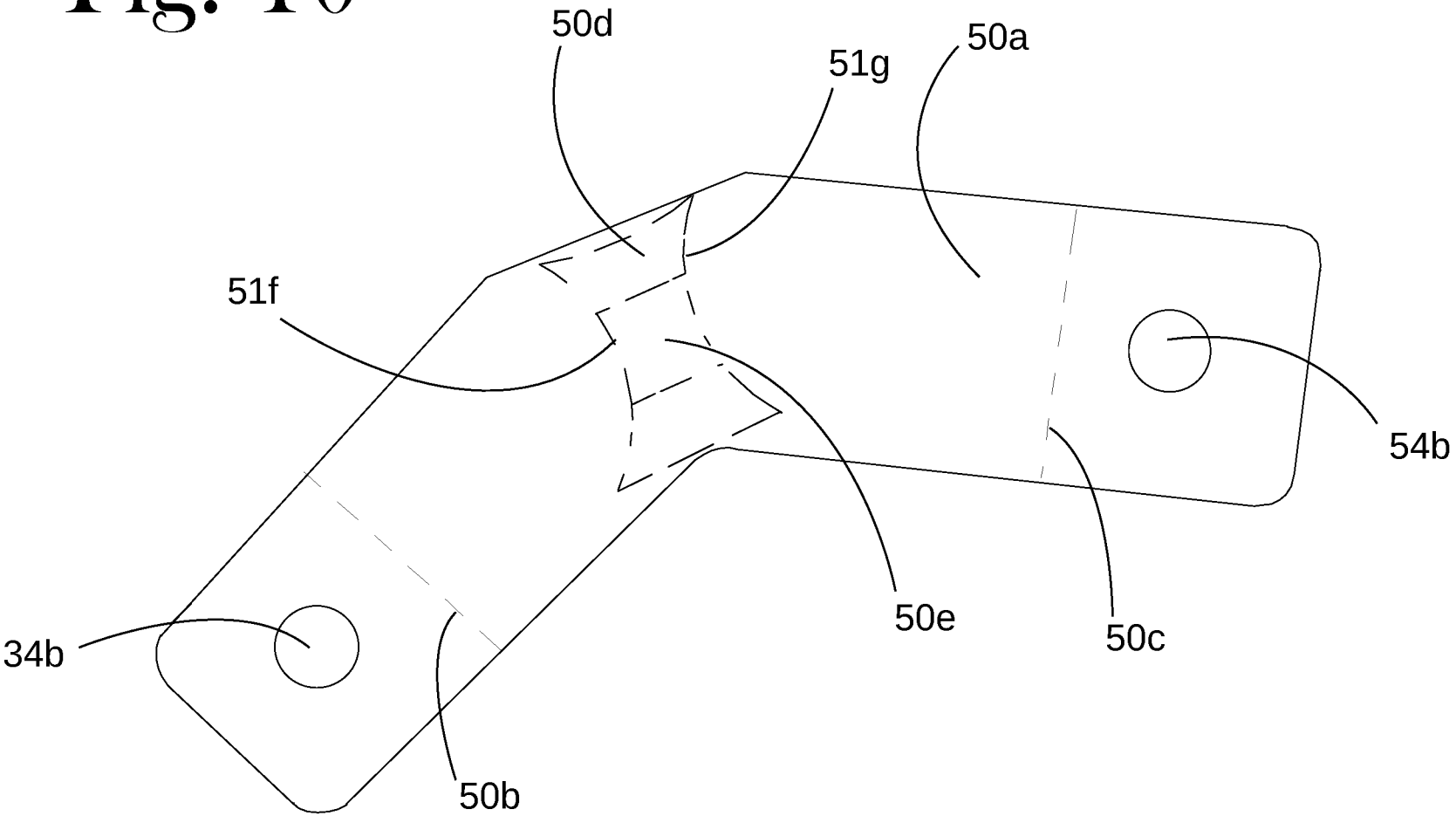
FIG. 10 is a rear perspective view of the pneumatic actuator support bracket.

FIG. 10 shows the present invention from a rearward perspective looking forward. Within the structure of the pneumatic actuator support bracket 50*a*, a first pneumatic actuator mounting channel 34*b* is noted. Likewise a second actuator mounting channel 54*b* is identified by its location horizontally opposite to the first pneumatic actuator mounting channel 34*b*. The position of the first recessed supporting face 50*b* is shown with hidden lines as is the relative location of the second recessed supporting face 50*c*. Hidden lines are also used to indicate features of the support bracket mounting brace 50*d* located on the forward side of the pneumatic actuator support bracket 50*a*. A first concave surface 51*f*, a second concave surface 51*g* and the support bracket mounting brace channel 50*e* are all depicted in relation to their physical locations.

Figure 11:
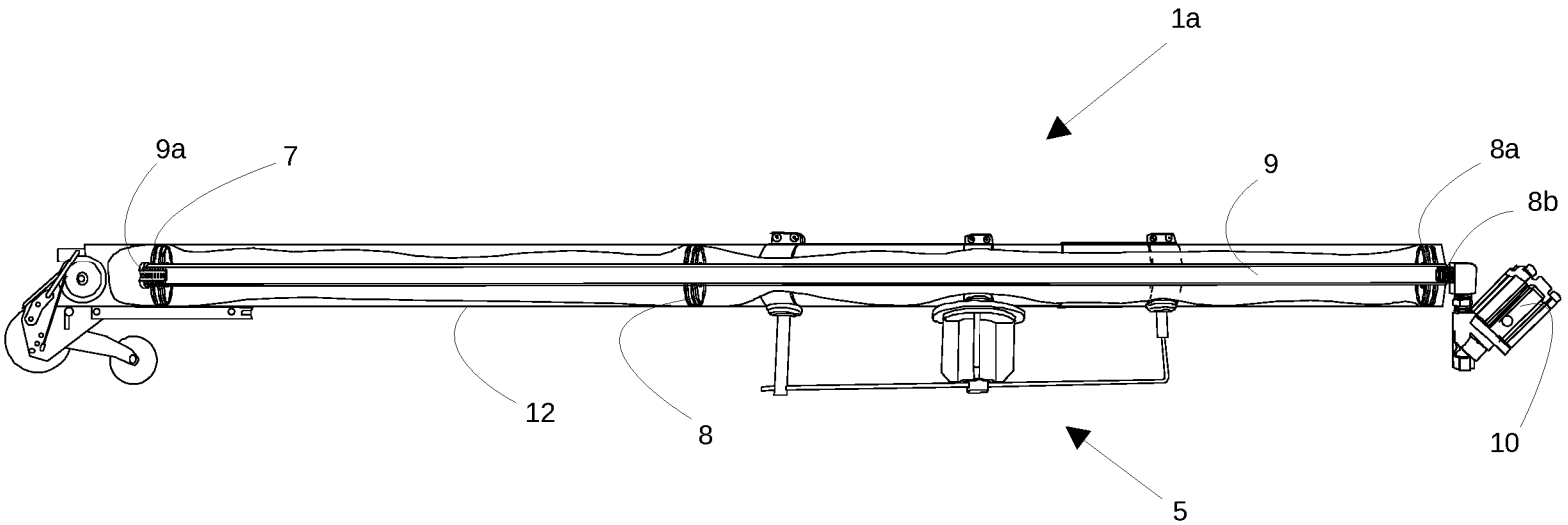
FIG. 11 is a section view of a typical drywall automatic tape applicator whereby the present invention is positioned within its structure providing a view of the mechanical relationship between both devices.

FIG. 11 provides a section side view of the automatic drywall tape applicator 1*a*. Mounted external of the material reservoir sleeve 12 is the standard paper tape holding assembly 5, and the compound control valve 10. Internal of the section view the following components are displayed;

the forward solid supply tube centering guide 7, the central vented supply tube centering guide 8 with the rearward vented supply tube centering guide 8*a* located at the rearward section of the device supporting the supply tube 9. 8*b* specifies the location of a threaded supply tube end 8*b*. 9*a* depicts the forward most location of a reducing orifice 9*a*.

Figure 12:
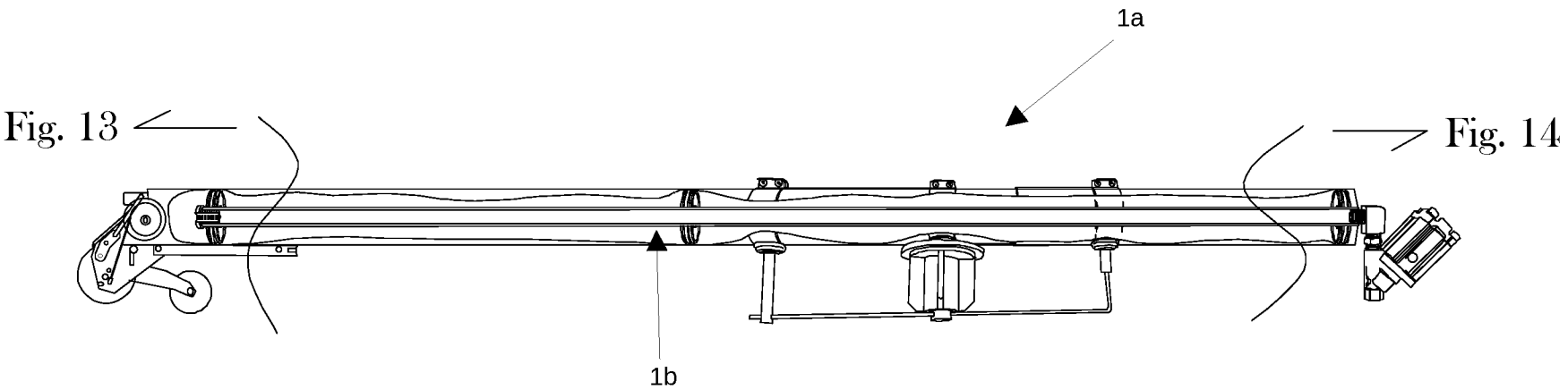
FIG. 12 is a section view of a typical drywall automatic tape applicator in mechanical relationship with the present invention notating viewing perspectives of drawing FIGS. 13 and 14.

FIG. 12 provides a general indication of the internal component placements of the present invention 1*b* within an automatic drywall tape applicator 1*a*. The drawing location of FIG. 13 is notated in a forward relationship to the present invention 1*b* as FIG. 14 notates in the rearward most area of the present invention 1*b* compared with an automatic drywall tape applicator 1*a*.

Figure 13:
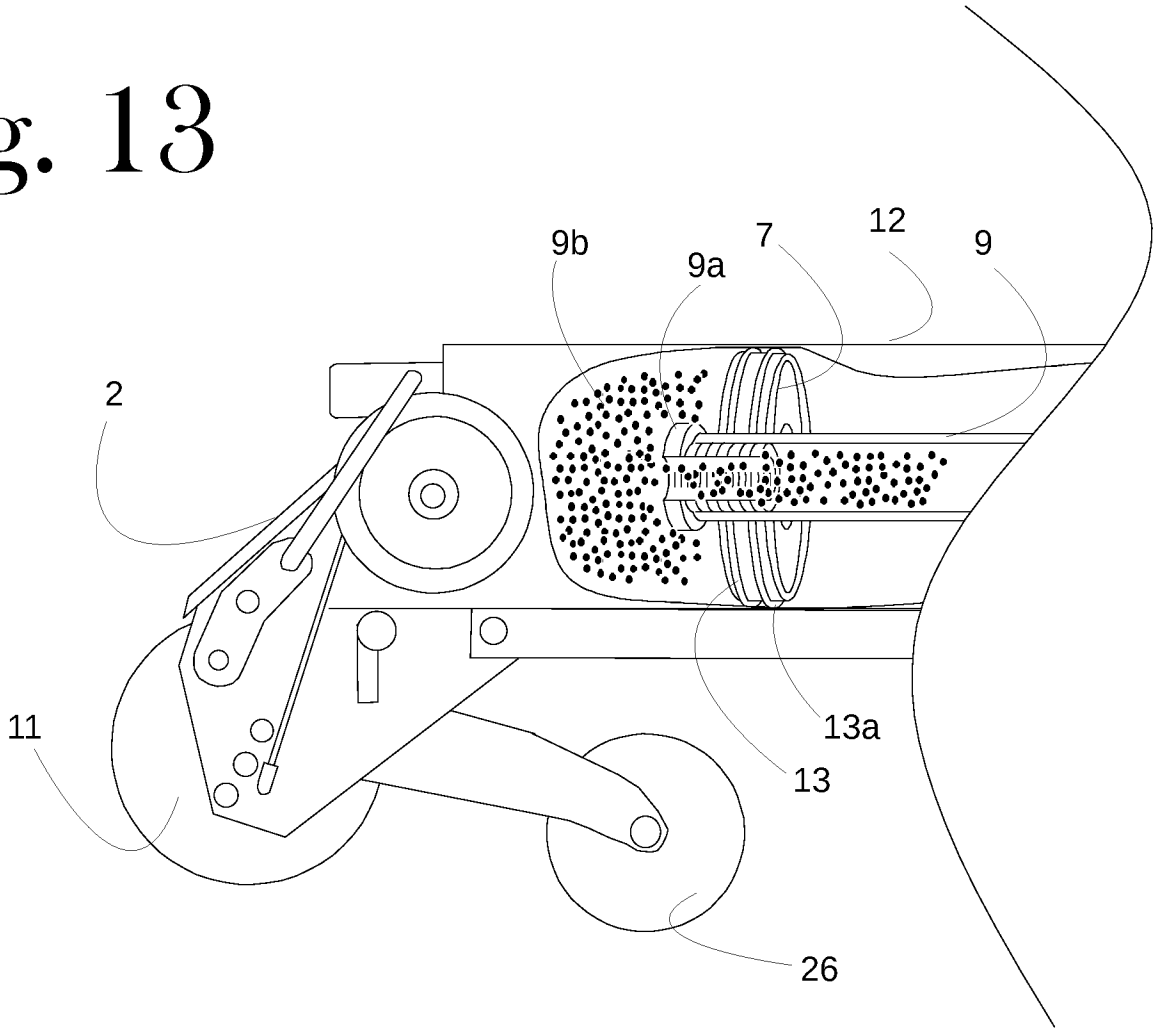
FIG. 13 is a section view of the forward end of an automatic tape applicator exposing the open end of the present invention by which drywall compound flows from the supply tube of the device into the taping head cavity of the automatic tape applicator.

FIG. 13 expresses a section view of the forward most section of the automatic drywall tape applicator whereby the automatic taping head 2 is affixed. Internally located within the material reservoir sleeve 12 is the forward solid supply tube centering guide 7 a supply tube 9 with a reducing orifice 9*a* metering the transfer of a drywall compound 9*b* from the rearward end of the present invention through the material reservoir sleeve 12. Also displayed are the relative locations of the primary sealing device 13, the secondary sealing device 13*a*, a tape roller wheel 11 and a corner wheel 26.

Figure 14:
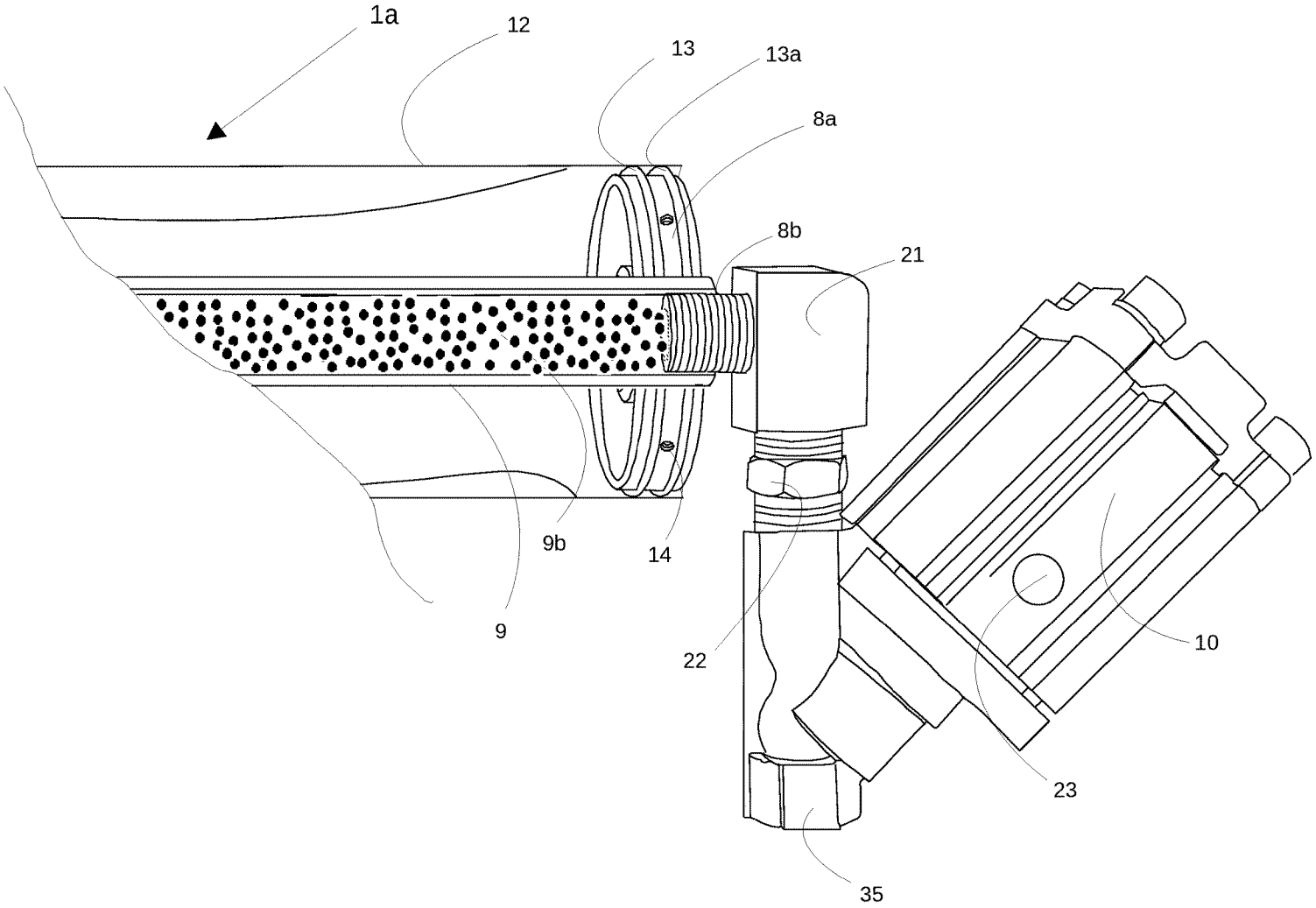
FIG. 14 is a section view of the rear section end of an automatic tape applicator indicating the entry of drywall compound into the rearward end of the supply tube of the present invention.

FIG. 14 illustrates the rearward section of the present invention clarifying the interrelationship between the standard automatic drywall tape applicator 1*a* and supply tube 9 being joined to a compound flow elbow 21 by its connection to threaded supply tube end 8*b*. At the opposite end of compound elbow 21 a nipple coupler 22 is affixed to a compound control valve 10. A compound receiving port 35 is located on the inlet side of the compound control valve 10 which receives drywall compound from a remote pumping source (not shown). A compound control valve inlet port 23 is shown in approximate location to the compound control valve 10.

Drywall compound 9*b* is illustrated within the supply tube 9 as it enters the rearward most end of the automatic drywall tape applicator 1*a* by way of the present invention. Primary sealing device 13 and the secondary sealing device 13*a* are affixed circumferentially to the rearward vented supply tube centering guide 8*a*. The rearward vented supply tube centering guide 8*a* contains a plurality of mounting apertures 14.

Figure 15:
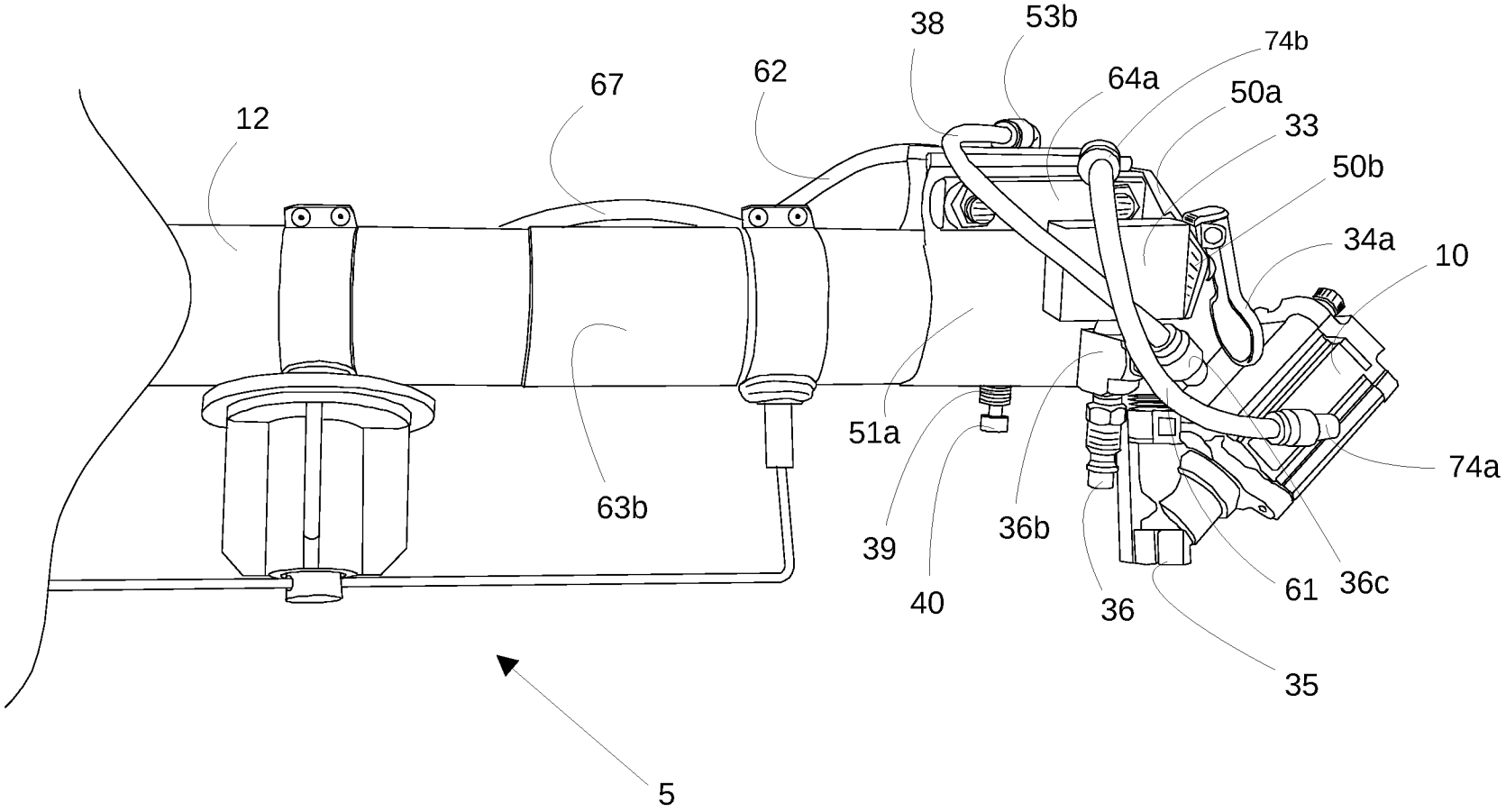
FIG. 15 is a perspective view of the physical proximity between the control system of the present invention and the paper tape holding assembly of an automatic tape applicator.

In FIG. 15 the paper tape holding assembly 5 is shown in physical relationship forward of the externally viewed components of the present invention. Pneumatic compound actuator 33 is supported by the pneumatic actuator support bracket 50*a* on the first recessed supporting face 50*b* forward side of the support bracket 50*a* with a compound actuator button lever 34*a* located on the rearward face of said pneumatic actuator support bracket 50*a*. A pneumatic supply connector 36 is shown affixed to a pneumatic supply connector T union 36*b*. At the opposite side of the pneumatic supply connector T union 36*b* connection is made to said pneumatic compound actuator 33. A corner wheel supply T union connector 36*c* is affixed to the third port of the pneumatic supply connector T union 36*b*. A corner wheel assembly supply conduit 38 is affixed at one end to the corner wheel supply T union connector 36*c* and at its other end to a corner wheel actuator inlet connector 53*b*. A compound control valve connector 74*a* is affixed to the compound control valve 10 supporting a compound control valve conduit 61 which is affixed at its differing end to an output connector 74*b*. The compound receiving port 35 is shown in relationship to the compound control valve 10. One end of a pneumatic pressure regulator 39 is illustrated as descending from the opposite side of the present invention that will be better clarified in FIG. 20. A pressure regulator adjusting screw 40 is internally fashioned to pneumatic pressure regulator 39. A pneumatic actuator support bracket band 51*a* is attached to the material reservoir sleeve 12 by circumferential friction as is a forward mounted linear actuator support bracket band 63*b*. The securing bolt support one 64*a* is shown in relationship with the pneumatic actuator support bracket band 51*a*. A linear actuator retrieving conduit 62 and a linear actuator advance conduit 67 are illustrated as being viewed on the opposite side of the present invention.

Figure 16:
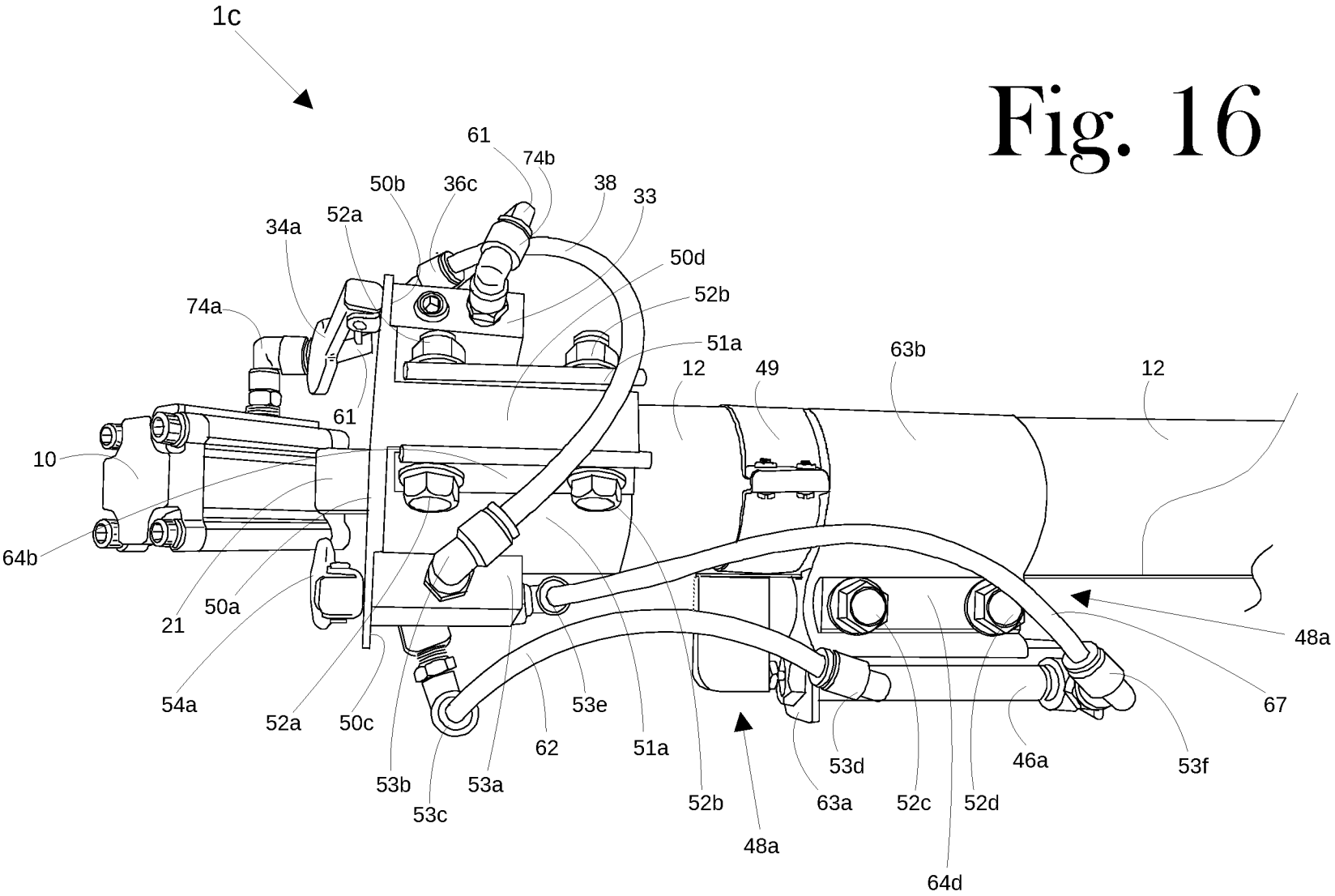
FIG. 16 is a rearward perspective top view of the control system of the present invention illustrating the physical proximity between the two control aspects of the present invention being the rearward located control system and the mounted corner wheel activation system.

FIG. 16 is a visual perspective from above the rearward end of the present invention looking down on the ergonomic control system 1*c*. The compound control valve 10 is shown in interconnected relationship with the compound control valve connector 74*a* along with the compound control valve conduit 61. The compound control valve 10 is illustrated partially below the compound flow elbow 21. The compound pneumatic button lever 34*a* is positioned on the rearward side of the pneumatic actuator support bracket 50*a* with the pneumatic compound actuator 33 being positioned in a first recessed supporting face 50*b* located on the forward side of the pneumatic actuator support bracket 50*a*. Pneumatic actuator support bracket 50*a* is provided in relational attachment to the pneumatic actuator support bracket band 51*a* by way of the support bracket mounting brace 50*d*. Located in direct proximity to the pneumatic actuator support bracket 50*a*, the pneumatic actuator support bracket band 51*a* is supported in position by the securing bolt support two 64*b* via a tightened engagement with a securing bolt assembly one 52*a* and a securing bolt assembly two 52*b*. The compound control valve connector 74*a* is provided in its mounted relationship to the compound control valve 10. The compound control valve connector 74*a* is affixed to the compound control valve conduit 61 at one end as the other end of the compound control valve conduit 61 is attached to the pneumatic compound actuator 33 at an output connector 74*b*. A corner wheel assembly supply conduit 38 is affixed at its first end to said corner wheel supply T union connector 36*c* with its other end connecting to a corner wheel actuator inlet connector 53*b*. Corner wheel pneumatic actuator 53*a* is affixed in a second recessed supporting face 50*c* of the pneumatic actuator support bracket 50*a* by way of attachment with a corner wheel actuator button lever 54*a* located on the rearward side of the pneumatic actuator support bracket 50*a*. A corner wheel actuator bypass first connector 53*c* is mounted to the corner wheel pneumatic actuator 53*a* whereby a linear actuator retrieving conduit 62 is attached having its other end affixed to corner wheel linear actuator 46*a* via the corner wheel advance connector 53*d*. The corner wheel linear actuator 46*a* is mounted to a linear actuator support bracket 63*a*. The linear actuator support bracket 63*a* (further clarified in FIG. 17) is anchored within a linear actuator support bracket band 63*b* that is held in place around the material reservoir sleeve 12 in a frictional constant utilizing a securing bolt support four 64*d* and a securing bolt support three 64*c* (not shown) by way of a securing bolt assembly three 52*c* and a securing bolt assembly four 52*d*. A linear actuator advance conduit 67 is anchored with its primary end affixed to a corner wheel actuator advancing first connector 53*e* and at the corner wheel actuator advancing second connector 53*f* at its other end. A paper tape rearward assembly band 49 is shown affixed to the material reservoir sleeve 12.

Figure 17:
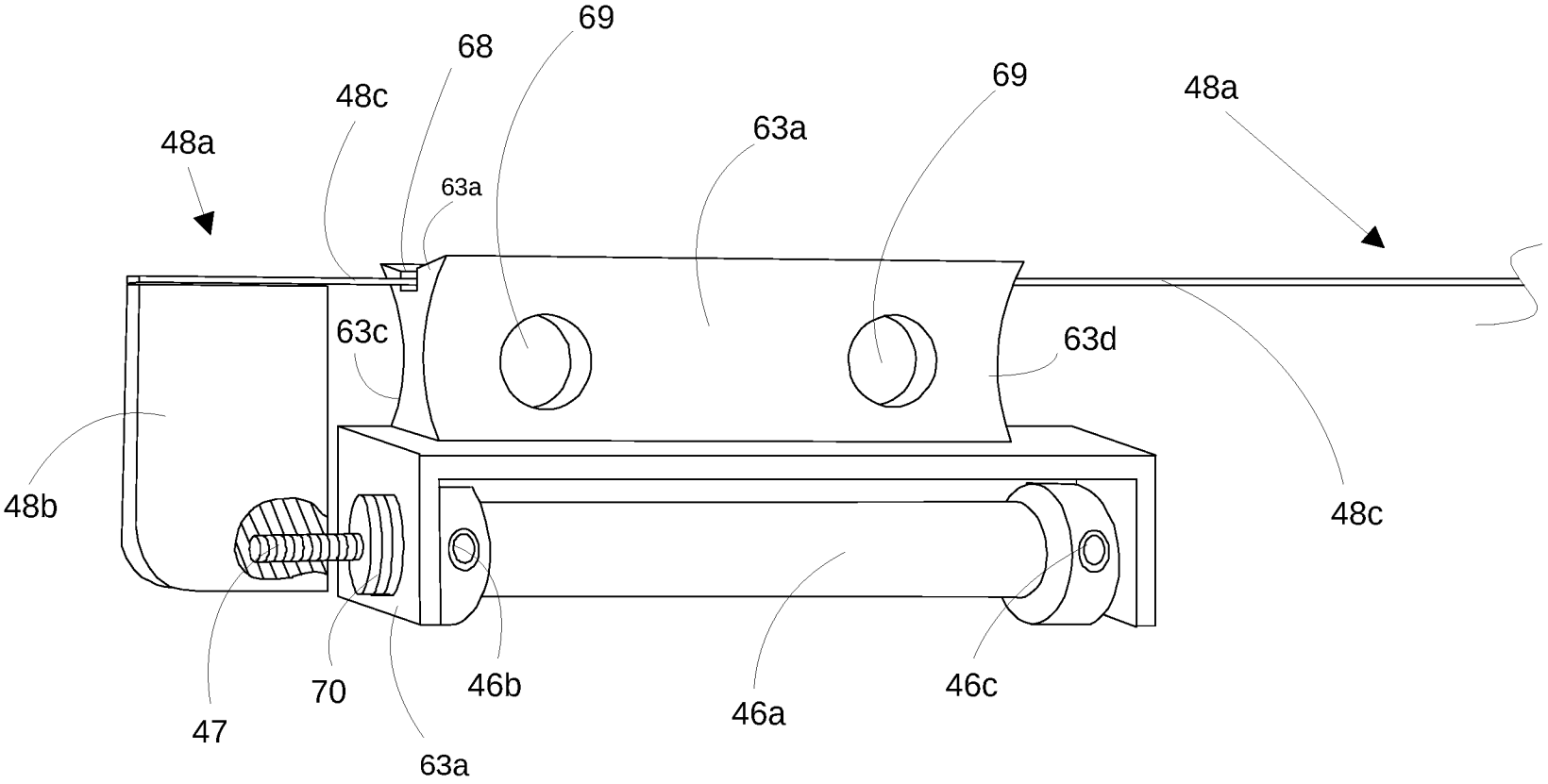
FIG. 17 is a perspective view of the mounting and activation methods of the corner wheel linear actuator components that are featured in the present invention.

Referring now to FIG. 17, the corner wheel linear actuator 46*a* is shown in relationship to the linear actuator support bracket 63*a* in threaded correlation with the linear actuator nose mount support 70. The corner wheel linear actuator 46*a* possesses a corner wheel actuator retrieving port 46*b* which is located toward the rearward direction of the present invention with a corner wheel advance port 46*c* which is located toward the forward direction of the present invention. The upper surface of the linear actuator support bracket 63*a* contains a control strap channel 68 through which a linear actuator control strap 48*c* is located. The linear actuator control strap assembly 48*a* consists of a linear actuator support bracket 48*b* that is affixed to the linear actuator control strap 48*c*. The illustration also provides a section view of the linear actuator support bracket 48*b* in a secured relationship to a corner wheel linear actuator rod 47. A plurality of securing bolt mounting channels 69 are provided within the body of the linear actuator support bracket 63*a*. Linear actuator concave surface one 63*c* is noted in opposite relationship to linear actuator concave surface two 63*d* having linear actuator support bracket 63*a* serve as intervening structural provision.

Figure 18:
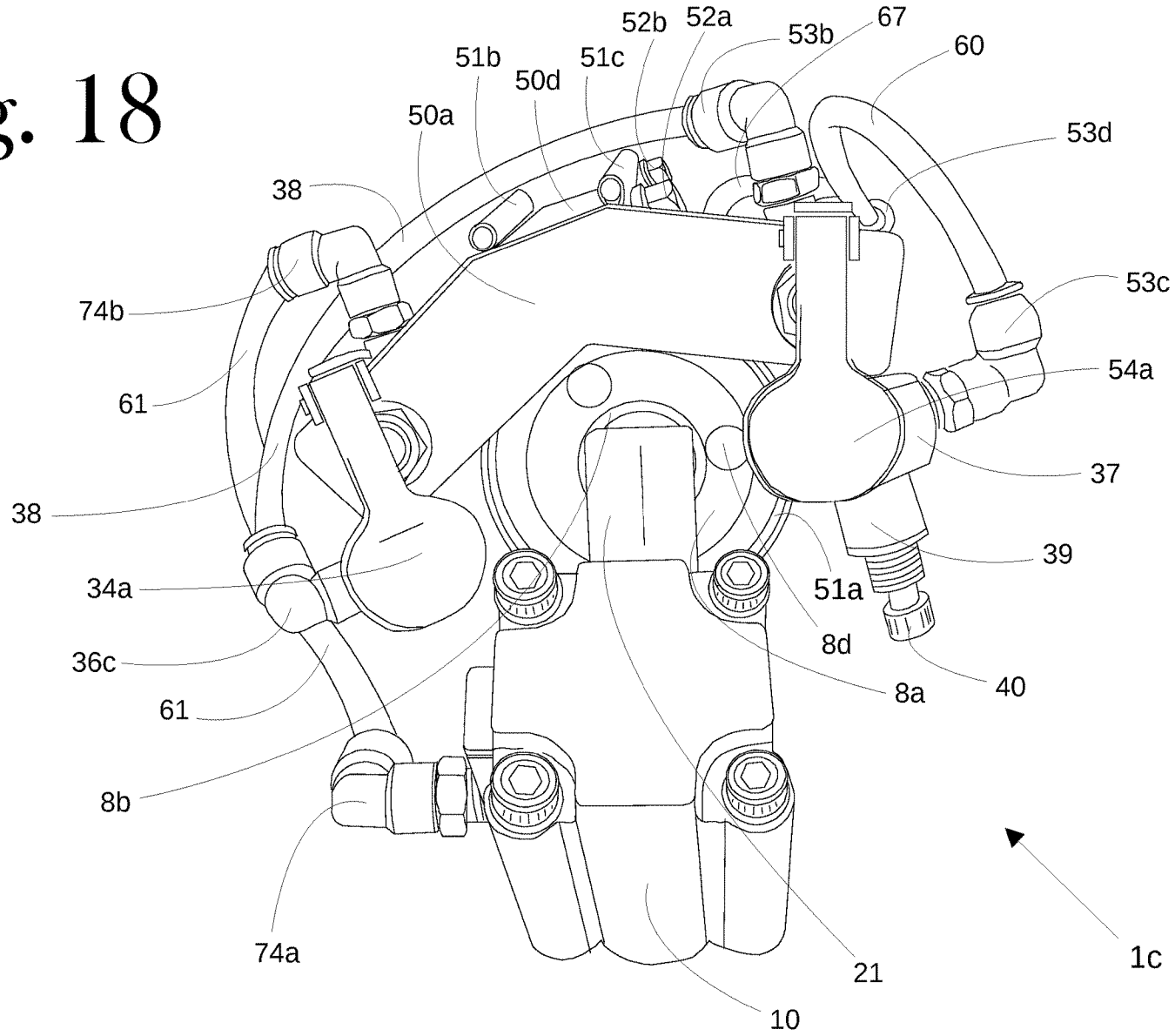
FIG. 18 is a view from a rear perspective of the present invention providing an enhanced view of relative components partly comprising the ergonomic control system.

In FIG. 18 the compound control valve 10 is viewed from the rearward end of the present invention looking forward providing its physical position in relation to the compound flow elbow 21. The compound control valve connector 74*a* is located on compound control valve 10 affixed to the compound control valve conduit 61 that is fitted with the output connector 74*b* at its opposite end. The compound actuator button lever 34*a* and the corner wheel actuator button lever 54*a* are positioned on the rearward face of the pneumatic actuator support bracket 50*a*. Unseen below the compound actuator button lever 34*a* is the pneumatic supply connector T union 36*b* which interconnects with the corner wheel supply T union connector 36*c* that connects with the rearward end of the corner wheel assembly supply conduit 38. The opposite end of the corner wheel assembly supply conduit 38 is affixed to the corner wheel actuator inlet connector 53*b*. The corner wheel retracting T union 37 is interconnected with the corner wheel actuator bypass first connector 53*c* that connects to the linear actuator retrieving conduit 60. The opposite end of the linear actuator retrieving conduit 60 connects to the corner wheel actuator bypass first connector 53*d*. The linear actuator advance conduit 67 can be seen behind the corner wheel actuator inlet connector 53*b*. The pneumatic pressure regulator 39 with its pressure regulator adjusting screw 40 can be viewed behind the corner wheel actuator button lever 54*a* and the corner wheel retracting T union 37. Partially viewed behind the pneumatic actuator support bracket 50*a* are the securing bolts 52*a* and 52*b* that provide tensioning force upon the pneumatic actuator support bracket band 51*a* by way of a first actuator bracket band support 51*b* and a second actuator bracket band support 51*c*. The rearward vented supply tube centering guide 8*a* has a plurality of internal vent passageways, one being noted as 8*d* in approximate in relation to the threaded supply tube end 8*b*.

In FIG. 19 viewing the present invention from a rearward sectioned perspective, pneumatic actuator support bracket 50*a* is displayed with its rearward face supporting compound actuator button lever 34*a* located on the leftward surface. On the rightward surface of the pneumatic actuator support bracket 50*a* the corner wheel actuator button lever 54*a* is positioned. The compound actuator button lever 34*a* is held in place by frictional engagement supplied by a compound actuator mounting nut 34*c* being threaded onto the pneumatic compound actuator 33 (FIG. 15). The corner wheel actuator button lever 54*a* is likewise held in place on the pneumatic actuator support bracket 50*a* by frictional engagement being supplied by a corner wheel actuator mounting nut 54*c*. The support bracket mounting brace 50*d* is comprised of two concave surfaces notated as a first concave surface 51*f* and a second concave surface 51*g* positioned lengthwise along opposing sides of the support bracket mounting brace 50*d*. Positioned adjacent to a first actuator bracket band support 51*b* is a securing bolt support one 64*a* held in place with a securing bolt assembly one 52*a*. On the second concave surface 51*g* a second actuator bracket band support 51*c* is likewise affixed in relationship to a securing bolt support two 64*b* and the support bracket mounting brace 50*d* being held in place utilizing a securing bolt assembly one 52*a* and a securing bolt assembly two 52*b*. The pneumatic actuator support bracket band 51*a* can be viewed as positioned in an external relationship to the material reservoir sleeve 12 located behind and forward of the pneumatic actuator support bracket 50*a*. Looking forward, a view of the rearward vented supply tube centering guide 8*a* can be seen mounted circumferentially to the supply tube 9. The side view of the secondary sealing device 13*a* indicates its position relation to the circumferential surface of the rearward vented supply tube centering guide 8*a* and the mating interior surface of the material reservoir sleeve 12. An internal vent passageway 8*d* and the seal shoulder 15*a* are also depicted in this view. The location of the threaded supply tube end 8*b* is shown as situated upon the interior surface of supply tube 9.

FIG. 20 is a graphic representation of the ergonomic control system 1*c* used in the present invention. A compressor source 60 is noted in relation to the compound actuator inlet port 33*a* that is supplying pressure to the pneumatic compound actuator 33 and simultaneously supplying pneumatic pressure to the corner wheel actuator inlet connector 53*b* being affixed to the corner wheel pneumatic actuator 53*a*. 33*c* denotes the location of a compound actuator originating port that supplies the compound control valve conduit 61 that is affixed to the compound control valve 10. The corner wheel pneumatic actuator 53*a* interacts with the corner wheel linear actuator 46*a* by way of the pneumatic pressure regulator 39 which receives system pressure from the corner wheel actuator bypass second connector 53*d* and then supplies regulated pressure through the linear actuator advance conduit 67 to the corner wheel advance port 46*c*. The corner wheel actuator bypass first connector 53*c* interconnects with the corner wheel actuator retrieving port 46*b* by way of the linear actuator retrieving conduit 62. Connected to the exhaust and vent ports of all functional pneumatic components are debris check valves 80.

How the Present Invention Achieves its Result

As previously described in the shortcomings of U.S. Pat. No. 4,090,914, the process of removing cable 37 along with piston 13 and cable 82 with lever 86 (FIG. 9) and stop ring 14 (FIG. 1) are well known and a standard repair procedure practiced in the drywall industry. These basic components are common in all automatic drywall tape applicators of the art. As such, to install the present invention these items are first removed from a standard automatic drywall tape applicator as shown in the exterior view of an automatic drywall tape applicator provided in FIG. 1.

In one embodiment of the present invention a standard automatic drywall tape applicator is prepared for the installation of the present invention as mentioned in the previous paragraph after which time the forward end of the device noted as the forward solid supply tube centering guide 7 shown in FIG. 2 is inserted into the rear section of the automatic drywall tape applicator's material reservoir sleeve 12 in FIG. 1 until a rearward vented supply tube centering guide 8*a* (FIG. 14) abuts with the rearward face of the material reservoir sleeve 12 whereby mounting screws (not shown) are inserted through existing channels in the material sleeve 12 and into the various mounting apertures 14 illustrated in FIG. 14 and also in FIG. 4 whereby they are firmly tightened.

The present invention consists multiple components, a portion of which include 3 centering guides noted in FIG. 11 as the forward solid supply tube centering guide 7 and the central vented supply tube centering guide 8 and the rearward vented supply tube centering guide 8*a*. All 3 of the centering guides are configured with external mounted sealing devices in circumferential locations notated as the primary sealing device 13 and a secondary sealing device 13*a* (FIG. 3). The term "solid" used in the forward solid supply tube centering guide 7 (FIG. 6) is defined by the solid body face of said centering guide to contain the drywall compound within the forward end of the automatic drywall tape applicator. The terms "vented" used in the central vented supply tube centering guide 8 and the rearward vented supply tube centering guide 8*a* refer to the internal vent passageways 8*d* best illustrated in FIG. 4. These passageways allow any leaking of drywall compound past the forward solid supply tube centering guide 7 (FIG. 11) to pass through the other two centering guides and eventually out the rear area of the present invention. Visual confirmation of drywall compound within the internal vent passageways 8*d* (FIG. 4) informs the technician of the leaking situation allowing him or her to replace the seals in the forward solid supply tube centering guide 7 and thus operate the taping process in a more efficient and light weight manner. The physical construction of the central vented supply tube centering guide 8 and the rearward vented supply tube centering guide 8*a* (FIG. 11) are similar in construction (FIG. 4) which include the primary sealing device 13 and secondary sealing device 13*a* (FIG. 3), the internal vent passageways 8*d*, the mounting shoulder 15, the seal shoulder 15*a*, and mounting apertures 14. Also included in FIG. 11 affixed centrally to each centering guide is a supply tube 9 that allows drywall compound to pass from the rear of the present invention by way of a compound control valve 10 to the front end of the automatic drywall tape applicator through the reducing orifice 9*a* (FIG. 13). The reducing orifice 9*a* may be temporarily or permanently attached to the supply tube 9 and is provided to prevent the weight of the drywall compound from emptying from the open end of the supply tube 9 and likewise out the front of the automatic taper via the opening that meters the amount of drywall compound that is applied on to the paper tape (not shown). The surface tension created by the reducing orifice 9*a* stops the flow of dormant drywall compound without having a significant detriment to the flow of drywall compound that is under pressure when the compound control valve 10 is activated. The inside diameter of the reducing orifice may vary due to the various mixing viscosities of drywall compound encountered. Job site research has suggested that 0.25 to 0.55 inch is the best inside diameter of the supply tube 9 for effective application of drywall compound. A similar result can be accomplished by providing a supply tube 9 that has an internal diameter of between 0.25 and 0.55 inches at its forward most point of construction. It is conceivable that the central vented supply tube centering guide 8 could be eliminated from the configuration to provide a cost of manufacturing savings, though it should also be noted that such an elimination would also provide less structural support to the design. Beginning at the rearward end of the present invention drywall compound is provided from a remote pumping source and delivered through a hose (not shown) to the compound receiving port 35 FIG. 14 of the compound control valve 10. The compound control valve 10 resides in a normally closed state until actuated upon by pneumatic input provided through the control valve pneumatic port 23. Once the compound control valve 10 is pneumatically activated to open the drywall compound 9*b* travels from the pumping source through the compound receiving port 35 continuing through the compound control valve 10 and furthermore into and through the compound flow elbow 21 by way of the connecting union 22 before entering the supply tube 9 and afterward flowing into the internal area of the material reservoir sleeve 12 (FIG. 13) located at the forward end of the automatic drywall tape applicator. The internal supply tube 9 is held in a relative position at the rear most end of the material reservoir sleeve 12 by the rearward vented supply tube centering guide 8*a* with screws (not shown) anchoring the two entities by way of the mounting apertures 14 (FIG. 14). A sealed condition is provided between the material reservoir sleeve 12 and the three centering guides noted in FIG. 11 as the forward solid supply tube centering guide 7 and the central vented supply tube centering guide 8 and the rearward vented supply tube centering guide 8*a* (FIG. 11) utilizing a frictional condition provided by the primary sealing device 13 and the secondary sealing device 13*a* (FIG. 14) pushing against the internal surface of the material reservoir sleeve 12. An alternate method for providing a means for sealing against the internal surface of an automatic drywall tape applicator is a Ucup seal which can be mounted to the forward surface of the forward solid supply tube centering guide 7 and the central vented supply tube centering guide 8 and the rearward vented supply tube centering guide 8*a* shown in FIG. 11. Any method of sealing against the internal surface of an automatic drywall tape applicator which provides the same seal function is acceptable within the structural design of the present invention.

Mounted externally at the rearward most end of the automatic drywall tape applicator (FIG. 16) is an ergonomic control system 1*c* mounted to a pneumatic actuator support bracket band 51*a* that engages a support mounting brace 50*d* holding the system firmly in position by way of securing bolt assembly one 52*a* and securing bolt assembly two 52*b*.

The support bracket mounting brace 50*d* comprises two opposing and concave mounting surfaces 51*f* being the first concave surface with item 51*g* (shown in FIG. 19) notating the second concave surface, both being located along a perpendicular axis to the pneumatic actuator support bracket 50*a* (a more detailed perspective of the support bracket mounting brace 50*d* with its relationship to the pneumatic actuator support bracket 50*a* can be seen in FIG. 9).

The pneumatic actuator support bracket band 51*a* (FIG. 19) is placed around the exterior of the material reservoir sleeve 12 with a first actuator bracket band support 51*b* and a second actuator bracket band support 51*c* being engaged with the support bracket mounting brace 50*d* along its first concave surface 51*f* with 51*g* being identified as the second concave surface by securing bolt support one 64*a* and securing bolt support two 64*b* being drawn together by the tightening of securing bolt assembly one 52*a* and securing bolt assembly two 52*b*.

The linear actuator support bracket band 63*b* (FIG. 16) is likewise placed around the exterior surface of the material reservoir sleeve 12 with both ends being engaged upon the two concave surfaces 63*c* and 63*d* (FIG. 17) of the linear actuator support bracket 63*a* (FIG. 17) with the linear actuator support bracket band 63*b* (FIG. 16) being pressed on each concave surface 63*c* and 63*d* (FIG. 17) with securing bolt support three 64*c* (not shown) and securing bolt support four 64*d* through which securing bolt assembly three 52*c* and securing bolt assembly four 52*d* are assured.

In FIG. 17 the linear actuator support bracket 63*a* consists of linear actuator concave surface one 63*c* and a linear actuator concave surface two 63*d* similar to the support bracket mounting brace 50*d* (FIG. 16) with an addition of a control strap channel 68 (FIG. 17) that is provided within the upper surface of the structure and a means for securing the corner wheel linear actuator 46*a* in position. The control strap channel 68 provides the linear actuator control strap 48*c* with the ability to move freely in linear movement allowing the unobstructed extension and retraction of the corner wheel 26 (FIG. 13). The linear actuator control strap 48*c* is constructed at its forward end with a flexible cable to conform with the existing functions of an automatic drywall tape applicator. At its rearward end the linear actuator control strap 48*c* is mated with a linear actuator support bracket 48*b* (FIG. 17). The mating of the linear actuator control strap 48*c* and the linear actuator support bracket 48*b* comprises the linear actuator control strap assembly noted as item 48*a* in FIG. 17.

In FIG. 16 the ergonomic control system 1*c* can be seen in relative position to the material reservoir sleeve 12. Mounted to the pneumatic actuator support bracket 50*a* is a pneumatic compound actuator 33 and a corner wheel pneumatic actuator 53*a*. In FIG. 15 pneumatic pressure is provided through an external source (not shown) to the present invention through a pneumatic supply connector 36. This connector is attached to a pneumatic supply connector T union 36*b* that supplies pneumatic pressure to the pneumatic compound actuator 33 and a corner wheel pneumatic actuator 53*a* (FIG. 16) through a corner wheel assembly supply conduit 38 and a corner wheel actuator inlet connector 53*b*. To begin the flow of drywall compound the technician simply engages the compound actuator button lever 34*a* which in turn activates the pneumatic compound actuator 33 providing pneumatic pressure to the compound control valve 10 opening the spring return valve and allowing drywall compound to flow through the present invention and onto the drywall tape. At the end of a run the technician releases the compound actuator button lever 34*a* to discontinue the flow of drywall compound. The technician then cuts the tape as he does with a conventional automatic drywall tape applicator known in the art. The compound control valve 10 is maintained in a normally closed state until activated upon by pneumatic pressure which is initiated from the compound actuator button lever 34*a*. One example of a compound control valve, fitting the requirements of this application is the SMC VXB series valve though it should not be interpreted that this is the only pneumatic valve that can be used. A wide variety of other valves can perform the same function.

Another aspect of my control system is a means to extend and retract a corner wheel 26 (FIG. 13) that is inherent to the structure and functional capabilities of a standard automatic drywall tape applicator. Generally referring to FIG. 16 the pneumatic pressure required to extend corner wheel 26 (FIG. 13) is produced by the activation of the corner wheel actuator button lever 54*a* (FIG. 16). Upon activation of the corner wheel actuator button lever 54*a*, the pneumatic pressure being provided to the corner wheel pneumatic actuator 53*a* reverses direction from its bypass state which supplies pneumatic pressure to the corner wheel actuator bypass second connector 53*d* on the corner wheel linear actuator 46*a* (FIG. 16) holding the corner wheel 26 (FIG. 13) in a retracted position. Upon activation of the corner wheel actuator button lever 54*a* the pneumatic pressure changes direction from its bypass state to allow pneumatic pressure to flow to the pneumatic pressure regulator 39 (FIG. 18 and FIG. 20). The technician has the ability to alter the pressure flowing through the pneumatic pressure regulator 39 by simply manipulating the pressure regulator adjusting screw 40 (FIG. 18) of the device. This method of adjusting a pneumatic regulator is offered in many configurations and is well known in the art. Upon achieving the required input from the technician the altered pressure leaving the pneumatic pressure regulator 39 (FIG. 18) proceeds to the corner wheel actuator advancing second connector 53*f* (FIG. 16) located on the corner wheel linear actuator 46*a* extending a corner wheel linear actuator rod 47 (FIG. 17) that presses upon the linear actuator support bracket 48*b* engaging the linear actuator control strap assembly 48*a* which in turn extends the automatic drywall tape applicator corner wheel 26 (FIG. 13) outward from the automatic drywall tape applicator. At the completion of taping a drywall corner seam the technician releases pressure on the corner wheel actuator button lever 54*a* (FIG. 18) which returns the corner wheel 26 (FIG. 13) to its retracted position. The technician then cuts the tape in the standard manner.

As drywall compound has various elements that may cause oxidation and pitting on the interior surface of a supply tube the invention incorporates a barrier element such as an epoxy coating upon the interior surface of the supply tube 9 and all other components that make contact with the flow of drywall compound whenever possible. While the superior coating to provide a barrier element to insulate metal surfaces from drywall compound has proven to be epoxy, any element or process that achieves a similar insulating property may be substituted.

As it has been described in previous sections of this application, pneumatic components are vulnerable to work site contaminants entering the various functions through exhaust ports or venting channels. As such, the present invention has provided various check valves to be included in the design at any point where system or functional air is exported or vented. An alternate method to protect the pneumatic system is to supply pneumatic tubing fitted at the exhaust or venting location of a pneumatic mechanism whereby its opposite open end is positioned at a location some distance from the component where the opposite end of the pneumatic tube is filtered or otherwise protected from the intake of contaminants.

Aftermarket Taper—Alternative Embodiment

An alternate method of affixing a compound control valve FIG. 11, item 10 to the present invention allows for the compound control valve FIG. 11, item 10 to be relocated from the exterior area of an automatic tape applicator FIG. 11, item 1*a* to within the material reservoir sleeve FIG. 11, item 12 having a fixed location between the forward solid supply tube centering guide FIG. 11, item 7 and the rearward vented supply tube centering guide FIG. 11, item 8*a* upon the supply tube FIG. 11, item 9 so as to provide a more ergonomically compatible and centralized point of gravity.

FIG. 21 is a perspective view of an alternative embodiment (81) of the present invention specifying the location of the forward solid supply tube centering guide 7 being in mechanical communication with the forward end of the supply tube 9. The rearward vented supply tube centering guide 8*a* is mechanically affixed to the apparatus at the further opposite end of the supply tube 9.

FIG. 22 provides an enhanced view of my alternative embodiment which includes a rotational actuated valve unit FIG. 22, item 85 as it is affixed between the two sections of the supply tube FIG. 22 item 9 having an anchored means of affixment FIG. 22, item 90 which is positioned on supply tube FIG. 22, item 9 having a rotationally means of attachment FIG. 22, item 92 to a spring retained single acting pneumatic cylinder FIG. 22, item 88. At the forward opposite end of the rotational means of attachment FIG. 22, item 92 the single acting pneumatic cylinder FIG. 22, item 88 a clevis FIG. 22, item 87 is secured to an extending rod (not shown) which is located within the single acting pneumatic cylinder FIG. 22, item 88. At the opposite side of the clevis FIG. 22, item 87 a rotational arm FIG. 22, item 86 is engaged with a means to provide rotational engagement FIG. 22, item 91 with said clevis FIG. 22, item 87. The rotational arm FIG. 22, item 86 is associated with the rotational actuated valve unit FIG. 22, item 85. A pneumatic fitting FIG. 6, item 89 is affixed to the spring retained single acting pneumatic actuator FIG. 22, item 88.

Operation of the Alternative Embodiment

To begin the flow of drywall compound the technician simply engages the compound actuator button lever FIG. 16, item 34*a* which in turn activates the pneumatic compound actuator FIG. 16, item 33 providing pneumatic pressure to the spring retained single acting pneumatic cylinder FIG. 22, item 88 by way of a pneumatic fitting FIG. 22, item 89 whereby at the forward end of the spring retained single acting pneumatic cylinder FIG. 22, item 88 the clevis FIG. 22, item 87, being secured to an extending rod (not shown) extends forward upon the rotational arm FIG. 22, item 86 providing engagement with the rotational actuated valve unit FIG. 22, item 85 allowing drywall compound to flow through the present invention and onto the drywall tape. At the end of a run the technician releases the compound actuator button lever FIG. 16, item 34*a* which disengages pressure to the single acting pneumatic cylinder FIG. 22, item 88 causing the spring retained single acting pneumatic actuator FIG. 22, item 88 to return to its retracted position discontinuing the flow of drywall compound through the device.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. An automatic drywall tape applicator, comprising:

a supply tube;

a solid supply tube centering guide engaged to said supply tube;

a vented supply tube centering guide engaged to said supply tube;

a compound control valve engaging said supply tube;

an actuator bracket, said actuator bracket disposed in communication with said supply tube;

at least one actuator, said at least one actuator disposed in communication with said actuator bracket;

a corner wheel pneumatic actuator in communication with said actuator bracket;

a pneumatic pressure regulator having inlet communication with said corner wheel pneumatic actuator;

a corner wheel linear actuator having inlet communication with said pneumatic pressure regulator; and a linear actuator control strap assembly having mechanical engagement with a corner wheel linear actuator rod.

2. The apparatus of claim 1, further comprising: a linear actuator support bracket band, said linear actuator support bracket band externally engaged with a surface of said automatic drywall tape applicator; and wherein said linear actuator support bracket band has a means of physical engagement with said corner wheel linear actuator.

3. The apparatus of claim 1, further comprising:

centering guides engaged centrally to the supply tube having a circumferential sealing relationship to the interior surface of a material reservoir sleeve of an automatic drywall tape applicator;

a compound control valve having an internal spring return mechanism;

an actuator support bracket being positioned in a perpendicular relationship to the longitudinal axis of said automatic drywall tape applicator;

wherein said corner wheel linear actuator having inlet communication with a pneumatic pressure source being in a normally open and retracted position when not acted upon;

a means of pneumatic activation whereby an actuator is engaged in a pulling fashion;

a means to reduce pneumatic contaminants from entering a pneumatic system comprising a check valve; and a means to reduce detrimental chemical reactions between a drywall compound and a metallic surface comprising a barrier element.

4. A method to provide a supplementary device for an automatic drywall tape applicator, comprising:

removing a cable and plunger assembly from an automatic drywall tape applicator;

removing a corner wheel finger trigger assembly ordinarily affixed to said automatic drywall tape applicator;

affixing the supplementary device to said automatic drywall tape applicator;

connecting a remote pumping source delivering drywall compound through a hose;

adjusting a pneumatic pressure regulator;

activating a compound control valve;

activating a corner wheel control valve;

rolling the automatic drywall tape applicator along a drywall joint applying tape;

deactivating a compound control valve;

activating a standard cutting mechanism of the automatic drywall tape applicator;

deactivating the corner wheel control valve; and advancing a new length of tape per the standard use of the automatic drywall tape applicator.

* * * * *